US011504569B2

(12) United States Patent
Hoover

(10) Patent No.: US 11,504,569 B2
(45) Date of Patent: Nov. 22, 2022

(54) MULTI-FUNCTIONAL EXERCISE STATION AND ANCHOR SYSTEM

(71) Applicant: Steven P. Hoover, Phoenix, AZ (US)

(72) Inventor: Steven P. Hoover, Phoenix, AZ (US)

( * ) Notice: Subject to any disclaimer, the term of this patent is extended or adjusted under 35 U.S.C. 154(b) by 0 days.

(21) Appl. No.: 17/741,230

(22) Filed: May 10, 2022

(65) Prior Publication Data

US 2022/0266084 A1 Aug. 25, 2022

Related U.S. Application Data

(63) Continuation of application No. 17/564,646, filed on Dec. 29, 2021.

(60) Provisional application No. 63/132,302, filed on Dec. 30, 2020.

(51) Int. Cl.

| | |
|---|---|
| ***A63B 21/16*** | (2006.01) |
| ***A63B 23/12*** | (2006.01) |
| ***A63B 21/055*** | (2006.01) |
| ***A63B 21/04*** | (2006.01) |

(52) U.S. Cl.

CPC ..... *A63B 21/169* (2015.10); *A63B 21/0442* (2013.01); *A63B 21/0557* (2013.01); *A63B 23/1209* (2013.01)

(58) Field of Classification Search

CPC ..... A63B 21/169; A63B 21/0442; A63B 21/0557; A63B 23/1209

See application file for complete search history.

(56) References Cited

U.S. PATENT DOCUMENTS

| | | | | | |
|---|---|---|---|---|---|
| D17,911 | S * | 11/1887 | Howell et al. | A63B 17/04 | 211/99 |
| 5,626,546 | A * | 5/1997 | Little | A63B 21/4001 | 482/904 |
| 5,997,448 | A * | 12/1999 | Duba | A63B 21/1681 | 482/121 |
| 6,267,711 | B1 * | 7/2001 | Hinds | A63B 21/1663 | 482/904 |
| 7,625,325 | B1 * | 12/2009 | Yost | A63B 21/169 | 482/904 |
| 9,149,677 | B2 * | 10/2015 | Rountree | A63B 23/0355 | |
| 9,314,658 | B2 * | 4/2016 | Kaye | A63B 23/03508 | |
| 9,370,682 | B2 * | 6/2016 | Piskin | A63B 23/1245 | |
| 10,035,036 | B2 * | 7/2018 | DiMartino | A63B 21/4007 | |
| 10,391,356 | B2 * | 8/2019 | Davis | A63B 21/16 | |
| 10,532,239 | B1 * | 1/2020 | Suarez Monne | A63B 17/04 | |
| 2006/0160681 | A1 * | 7/2006 | McBride | A63B 1/00 | 482/129 |
| 2011/0237410 | A1 * | 9/2011 | Perez | A63B 21/16 | 482/129 |
| 2014/0031182 | A1 * | 1/2014 | Donofrio | A63B 21/0552 | 482/129 |
| 2019/0118022 | A1 * | 4/2019 | Carter | A63B 21/16 | |

* cited by examiner

*Primary Examiner* — Andrew S Lo

(74) *Attorney, Agent, or Firm* — Christopher Mayle; Bold IP PLLC

(57) ABSTRACT

The present invention is directed to a system and method for attaching exercise modalities such as elastic tubular resistance bands, elastic flat resistance loops, non-elastic suspension-type exercise systems in a plurality of different positions and orientations as well as other exercise, rehabilitation and stretching components that either require or benefit from a stationary anchor unit.

11 Claims, 31 Drawing Sheets

Bar Curl

Bar Squat

Overhead Bar Press

Bar Pull-down

Bar Bench Press

Lying Band Flyes

Lying One-Hand press

One-Arm Extension/Press

One Arm Curl w/ Handle

One Arm Curl w/o Handle

One Arm Lateral Extension

Rear Delt Row

Standing Chest Fly

Overhead Tricep Extension

Reverse Grip Tricep Extension

Ring Chest Dip

Suspension Chest Fly

Suspension Push-Up

Suspension Lat row

Suspension Line Squat

Abdominal Crunch

MULTI-FUNCTIONAL EXERCISE STATION AND ANCHOR SYSTEM

CROSS REFERENCE TO RELATED APPLICATIONS

This application is a continuation of U.S. patent Ser. No. 17/564,646 filed on Dec. 29, 2021 which claims priority to U.S. Provisional Patent 63/132,302 filed on Dec. 30, 2020, which are incorporated herein by reference in their entirety.

BACKGROUND

Regular physical activity can improve muscle strength and boost endurance. Exercise delivers oxygen and nutrients to bodily tissues and helps the cardiovascular system work more efficiently. Exercise helps people lose weight and lower the risk of some diseases. Exercising regularly decreases a person's risk of developing certain diseases, including obesity, type 2 diabetes, and high blood pressure. Exercise can help a person age well. Traditional exercise machines provide exercises in a unidirectional manner whereby traditional machines do not provide workouts for multiple body muscles, sometimes requiring multiple pieces. Another hassle with most traditional workouts is the positioning of weights such as dumbbells which may strain the muscles and knees when lifting the weights of the ground each time. Thus, there is a need for an improved exercise device offering the freedom to work out the body in a variety of positions without the continuous need for lifting free weights.

SUMMARY

The embodiments of the present invention are directed to an exercise system that is a component-based system for attaching exercise modalities such as elastic tubular resistance bands, elastic flat resistance loops, non-elastic suspension-type exercise systems as well as other exercise, rehabilitation and stretching components that either require or benefit from a stationary anchor unit.

The exercise system includes multiple components: two vertical anchor support tubes with loop hooks unique to this system spaced along the vertical to facilitate exercises requiring varied heights as well as providing a method for anchoring static exercise straps, stretching elastic bands or elastic resistance loops. The system incorporates a product-specific designed loop hook anchors that are spaced from just above ground level to overhead. In addition to the vertical anchor tubes, the system has horizontal anchor support tubes that protrude perpendicularly from the vertical plane away from the wall/mounting surface that have additional loop hook anchor points which also serve as mounting points for the resistance bar component of the system to be used as a pull-up bar.

The resistance bar component can be utilized for pull up exercises and hanging stretches when mounted on the horizontal tube loop hooks. The horizontal anchor points also provide additional exercise variations in contrast to those performed on the vertical. The resistance bar has integral anchor points to attach to resistance bands and resistance loops to provide bar-type exercise options (i.e. curls, squats, push and pull movements). The vertical anchor support tubes are anchored to a sturdy structural member such as wall studs or concrete or masonry walls by means of lag bolts or masonry anchors or can be mounted to a mounting board which is itself attached to a structural component.

The horizontal anchor tube is joined to the vertical anchor tube with a slip fit member that slides into the top of the vertical tube and accepts a through both that affixes one to the other as well as has an integral top support gusset flange that also is bolted to the wall/substrate in the same manner as the vertical anchor tube it is mated with. The unique loop anchor points of this system facilitate many varied methods of attaching bands, loops and straps in ways that provide a tremendous range of options for the user and allow for a greater variety of uses than current resistance anchor systems. Loop hook anchors allow users to simply hook over the open end of the loop hook as one would a traditional "hook". During use, resistance bands, resistance loops or straps may be affixed by any number of methods to perform any number of exercises while allowing the user to adjust length, the direction of movement, angle of exercise resistance or to increase resistance force.

DETAILED DESCRIPTION

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
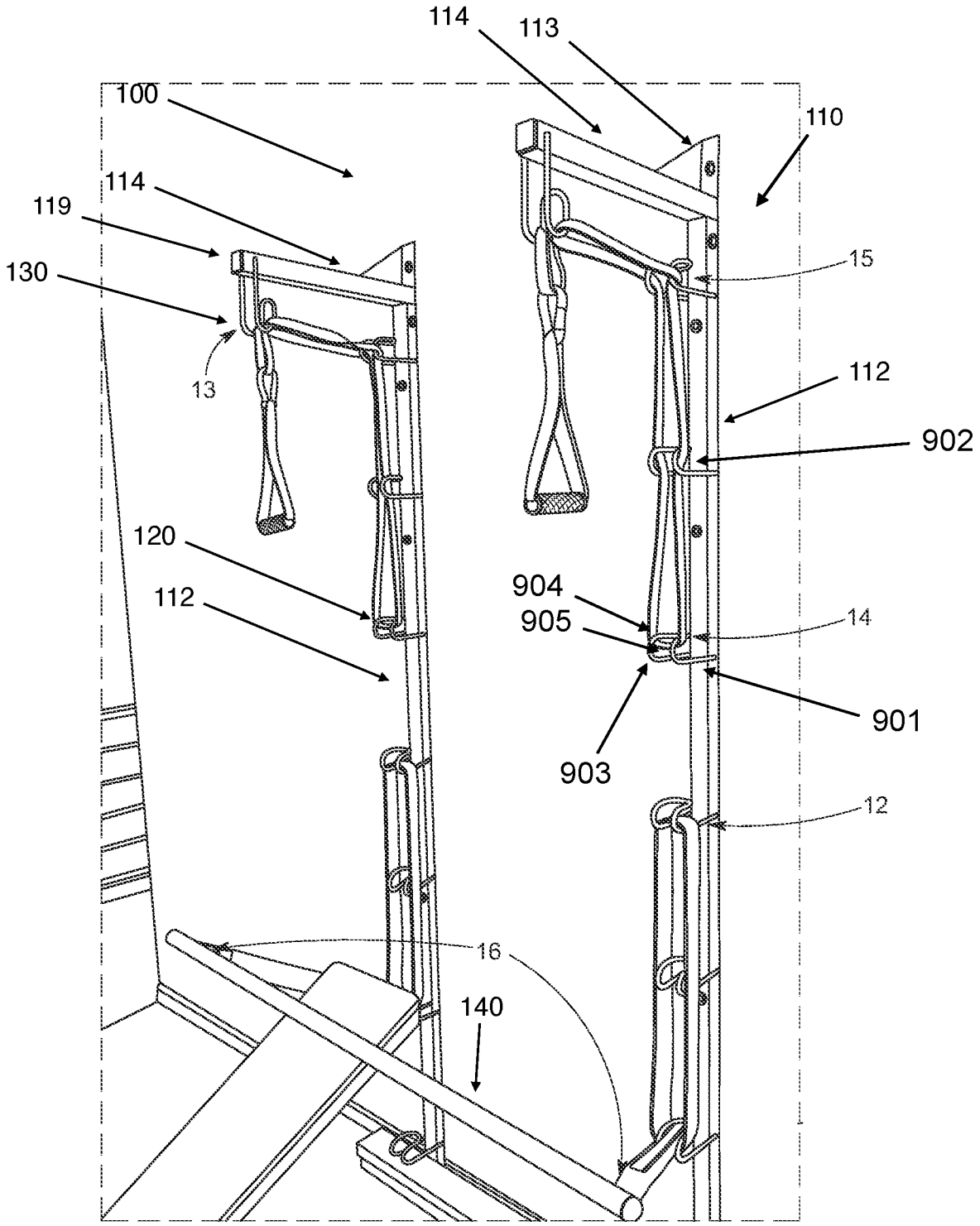
FIG. 1 shows an illustration of an exercise station in accordance with the present invention.
Figure 2:
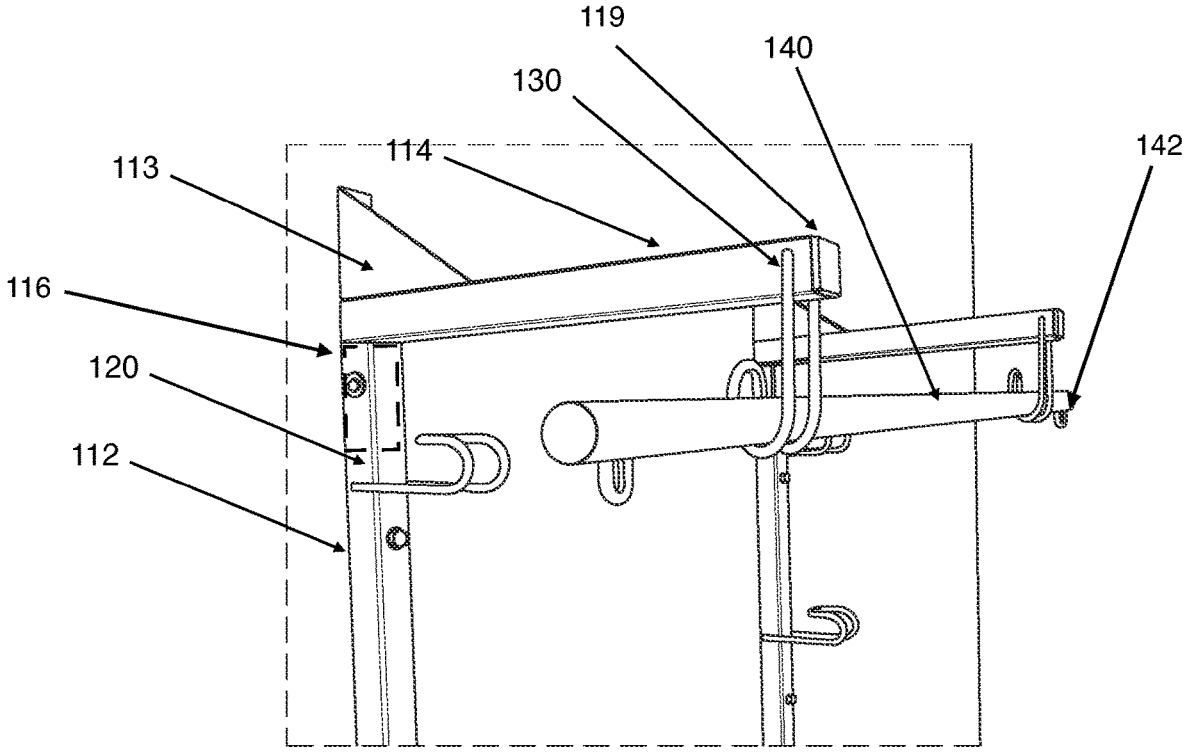
FIG. 2 illustrates a pull up bar in the horizontal bar loop hook anchors.

FIGS. 1-2 depicts a non-limiting embodiment of an exemplary multi-functional exercise station and anchor system 100 in accordance with the present invention. Multi-functional exercise station and anchor system 100 system may have a frame 110 with two vertical members 112 and two horizontal members 114 positioned on opposite sides of frame 110 whereby horizontal members 114 protrude perpendicularly from the vertical plane of the wall and vertical members 112. Vertical members 112 may be positioned any distance apart, however in a preferred embodiment they are 32 inches apart.

Vertical members 112 and the horizontal members 114 may be made of metal, carbon fiber, wood, or any other suitable material designed for longevity and prolonged use during exercise. In one non-limiting embodiment vertical members 112 and horizontal members 114 may have a rectangular prism shape however this non-limiting and may be a triangular, octagonal, or hexagonal prism or a cylinder. Vertical members 112 and horizontal members 114 may be any thickness but in one embodiment may be 1.5 inches thick 14 gauge. Vertical members 112 and may be any height but in one embodiment may be 8 to 10 feet. This may vary depending on the material and circumstances needed for the members as well as the plants that will be hung.

In one or more non-limiting embodiments the members may be telescopic with an inner component and outer component whereby the outer component may move relative to the inner component. The upward motion of the outer component relative to the inner component shortens the member whilst a downward motion of the outer component relative to the inner component lengthens the member. The member may have an adjusting mechanism or latch mechanism to adjust the height of the members and then secure the height such that the user may adjust the height of the system to accommodate for varying distances between beneath the ground and the members. Members may have a twist locking system. Members may have a push button mechanism that releases a latch mechanism onto a disengaged position whereby the outer component of the extension body may freely move relative to the inner component in a linear telescopic motion.

In some embodiments the ends of the inner component and outer component may be designed to prevent complete displacement of the inner component from the outer component or have a method or system such as a gasket, crimping, or any other known methods or systems to those of ordinary skill in the art to prevent complete displacement of the inner component from the outer component.

Vertical members 112 may be directly or indirectly connected to the horizontal members 114. Vertical members 112 may be removably connected to the horizontal members 114 by one or more slip-fit inserts. Horizontal members 114 may each have a welded slip-fit insert 116 at an end of horizontal members 114 positioned at a specific angle such as 90 degrees whereby slip-insert 116 is positioned inside a top opening of vertical members 112. Once slip-inserts 116 has been inserted into vertical members 112 they may be fastened to vertical members 112 by one or more position locking pins that may be placed through coaxially aligned apertures in vertical members 112 and slip-inserts 116 and be secured in place thus fastening horizontal members 114 to vertical members 112. In other embodiments vertical frame components, be affixed to the horizontal frame component by any number of fasteners, adhesive, latches, hinges, welding techniques, or any other method known to those skilled in the art. On opposite ends of the connection between vertical members 112 and horizontal members 114 may be one or more end caps made of rubber, plastic, metal, or another material to protect the user from harmful contact against the edges of frame 110. The end caps may be friction fit or welded. In further embodiments vertical members 112 may be designed to be disconnected to save space and stored away or connected to the ceiling.

Horizontal members 114 may have one or support gussets 113 for strength and securing horizontal members 114 to a structural support. Support gussets 113 may be positioned at the first end of horizontal members 114 on an upper surface. Support gussets 113 may have a rectangular portion extending upward from horizontal members 114 and a triangular portion connected to the rectangular portion along one length and the top of horizontal members 114 along a second length. Support gussets 113 may have one or more retainer holes. Further, a position-locking pin may be placed through retainer holes of support gussets 113 to secure support gussets 113 to a wall or another support surface.

Vertical members 112 may have one or more retainer holes whereby one or more lag bolts or masonry anchors may anchor vertical members 112 to a sturdy structural member such as wall studs, concrete, or masonry walls. In one or more non-limiting embodiments a mounting board or other components may instead be attached to a structural component. A plurality of vertical loop hooks 120 unique to this system may be welded to vertical members 112 and spaced along vertical members 112 from just above ground level to overhead to facilitate exercises requiring varied heights. In other non-limiting embodiments loop hooks may be connected to vertical members 112 by any number of fasteners, adhesive, latches, hinges, welding techniques, or any other method known to those skilled in the art.

Vertical loop hooks 120 may include a metal or other durable material. The main hooks may have a L-shape with a first and second component on opposite sides of vertical members 112 whereby each component has a shank 901, a gape 902, a bend 903, a throat 904 and throat opening 905. Vertical loop hooks 120 may be 0.375 inches thick with a shank that is 2.75 inches in length, a gape that is 1.25 inches or greater in length, a throat that is 1.5 inches in length, and a distance of 1.5 inches between points on the bend where the distance is parallel to the gape.

A plurality of horizontal loop hooks 130 unique to this system may be welded to horizontal members 114 and spaced along horizontal members 114 which also serve as mounting points for the resistance bar component of the system to be used as a pull-up bar. In other non-limiting embodiments loop hooks may be connected to horizontal members 114 by any number of fasteners, adhesive, latches, hinges, welding techniques, or any other method known to those skilled in the art.

Horizontal loop hooks 130 may be 0.375 inches thick with a shank that is 2.75 inches in length, a gape that is 1.25 inches or greater in length, a throat that is 1.5 inches in length, and a distance of 1.5 inches between points on the bend where the distance is parallel to the gape. The loop hooks may be metal and formed from one or more wires, cables, or sheets, that have been bent into a hook shape or by any other suitable means. Loop hooks are of sufficient wire diameter to provide adequate strength to support applied loads from users and components restrained by attachment points, loop hooks, and overall assembly.

An exercise bar 140 may be positioned in horizontal loop hooks 130 or connected to other components. Exercise bar 140 may have one or more anchor members 142 positioned at opposite ends of exercise bar 140 such that members 142 are positioned on the outsides of horizontal loop hooks 130. In one non-limiting embodiment, exercise bar 140 may be 48 inches wide, 1.25 inches in diameter, and 14 gauge steel. At ends of exercise bar 140 may be end caps made of plastic, rubber, or metal. The end caps may be friction fit or welded.

During use a user can thread a resistance band, resistance loop or strap through the space within loop hooks 120 and 130 and then double back on the resistance band, resistance loop or straps thereby locking it to the anchor point. Additionally, resistance bands, resistance loops or straps can be connected with a mechanical connection such as a tie strap or spring-type clip like a climbers carabiner. Resistance bands, resistance loops or straps can be threaded "inside" multiple loop hooks and then affixed by any of the described methods to adjust length, the direction of movement, angle of exercise resistance or to increase resistance force.

FIG. 1 illustrates the various anchoring methods for resistance bands. Reference numeral 12 illustrates a resistance band 200 hooked over a first vertical loop hook 120 increasing resistance on resistance band 200 and then threaded through a second vertical loop hook 120 to re-route resistance band 200. Reference numeral 13 illustrates a resistance band threaded through "eyelet" of a first horizontal loop hook 130 whereby resistance band 200 is connected to accessory handles 300 for a pull-down type exercise. Reference numeral 14 illustrates a resistance band 200 loop restrained by a third vertical loop hook 120. Reference numeral 15 illustrates a resistance band 200 threaded through a fourth vertical loop hook 120 to re-route resistance band 200. Reference numeral 16 illustrates exercise bar 140 and anchor members 142 that allow restraint straps or spring clips to connect resistance bands 200 to exercise bar 140 where exercise bar 140 is orientated bench press type position.

Figure 3:
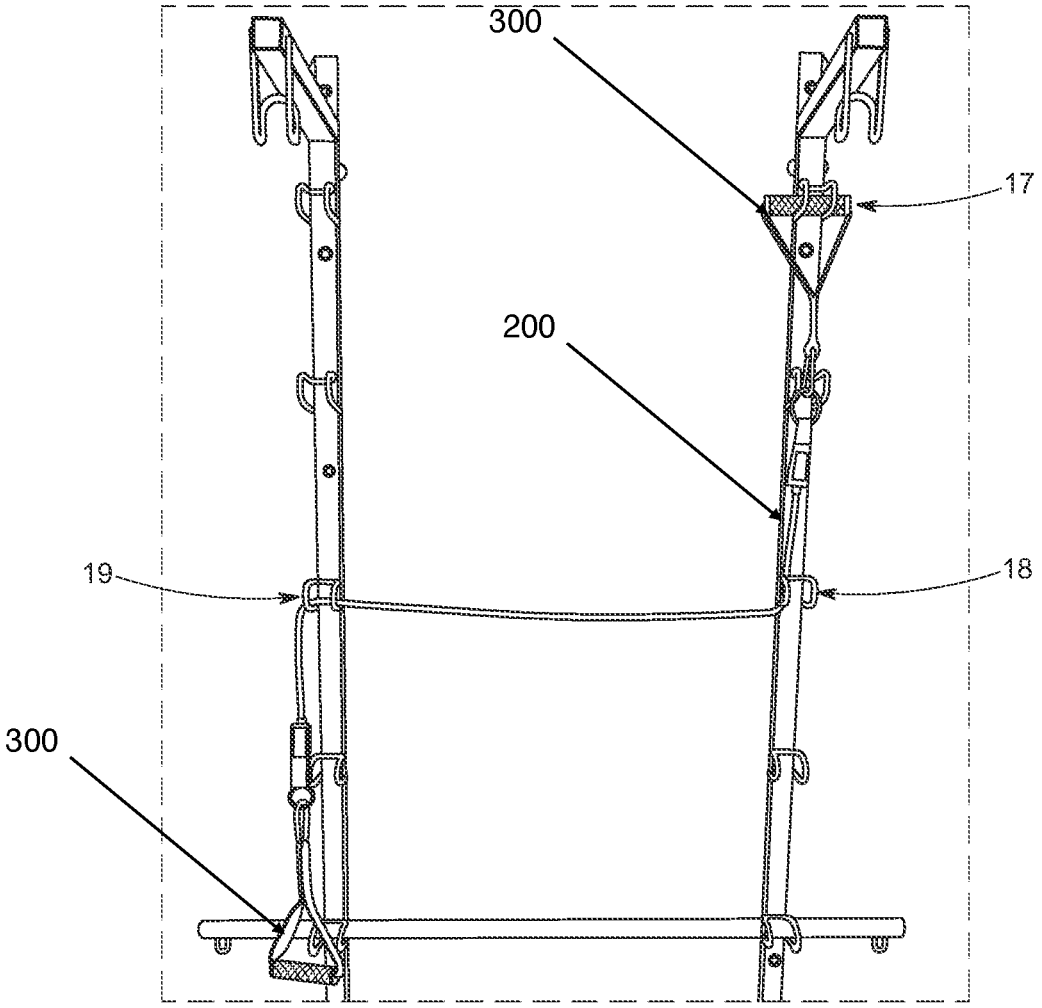
FIG. 3 illustrates methods of band restraint.

FIG. 3 illustrates more anchoring methods for resistance bands. Reference numeral 17 illustrates the utilization of a first loop hook 120 to restrain accessory handles 300. Reference numeral 18 illustrates resistance band 200 threaded through the eyelet of a second vertical loop hook 120 to increase resistance and/or change resistance band 200 for the purpose of specific exercises. Reference numeral 19 illustrates resistance band 200 restrained by a third vertical loop hook 120 for exercise positioning.

Figure 4:
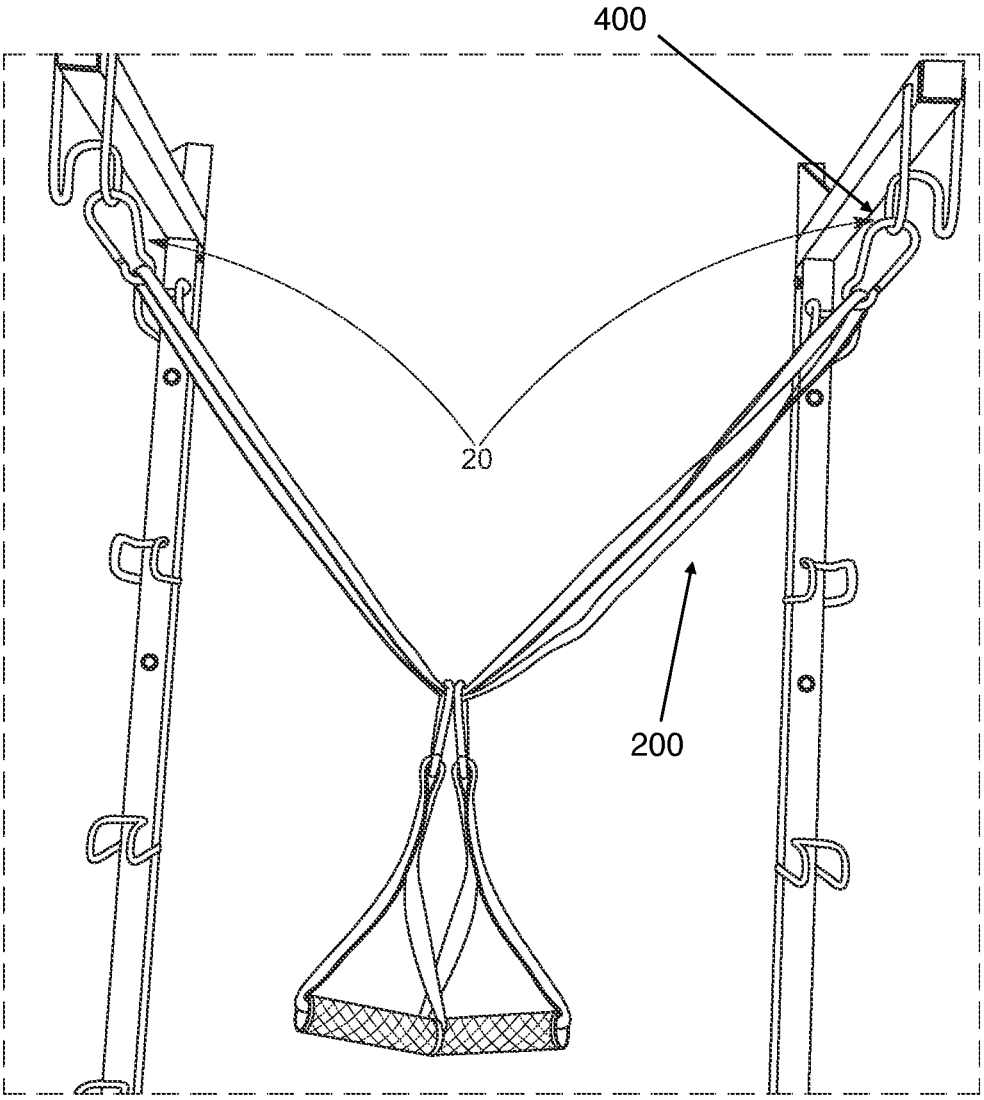
FIG. 4 illustrates further methods of band restraint.

FIG. 4 illustrates more anchoring methods for resistance bands. Reference numeral 20 illustrates a resistance band 200 secured to horizontal loop hooks 130 by means of spring clips 400.

Figure 5:
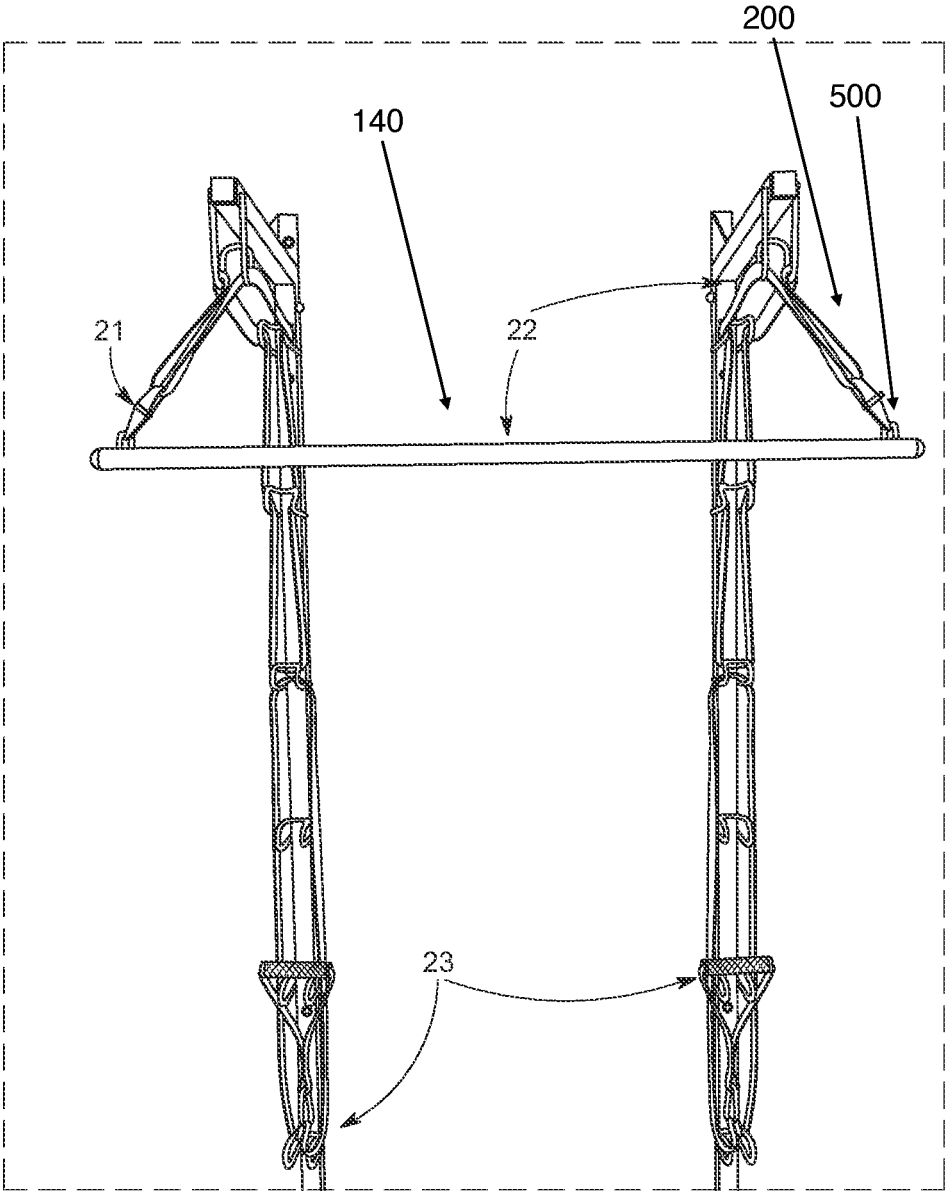
FIG. 5 illustrates further methods of band restraint.

FIG. 5 illustrates more anchoring methods for resistance bands. Reference numeral 21 illustrates exercise bar 140 affixed to resistance band 200 by means of restraint straps 500. Reference numeral 22 illustrates exercise bar 140 attached in an overhead exercise position. Reference numeral 23 illustrates accessory handles 300 and/or resistance bands 200 in a low position for performing curl vertical press exercises FIGS. 6-31 illustrate exercises utilizing various components, accessories and attachment options. Illustrations do not represent the complete library of possible exercises but are shown to illustrate the wide variety of typical exercise movements the system is capable of providing. Utilizing the basic system will provide many of the same exercise variations that much more expensive weight based exercise platforms provide without the need for a large assortment of weight plates, barbells, dumbbells and/or cable-type weight stations. Adding accessories, such as ring accessories, handles, ankle/wrist cuffs and suspension straps provides numerous additional exercise options.

Figure 6:
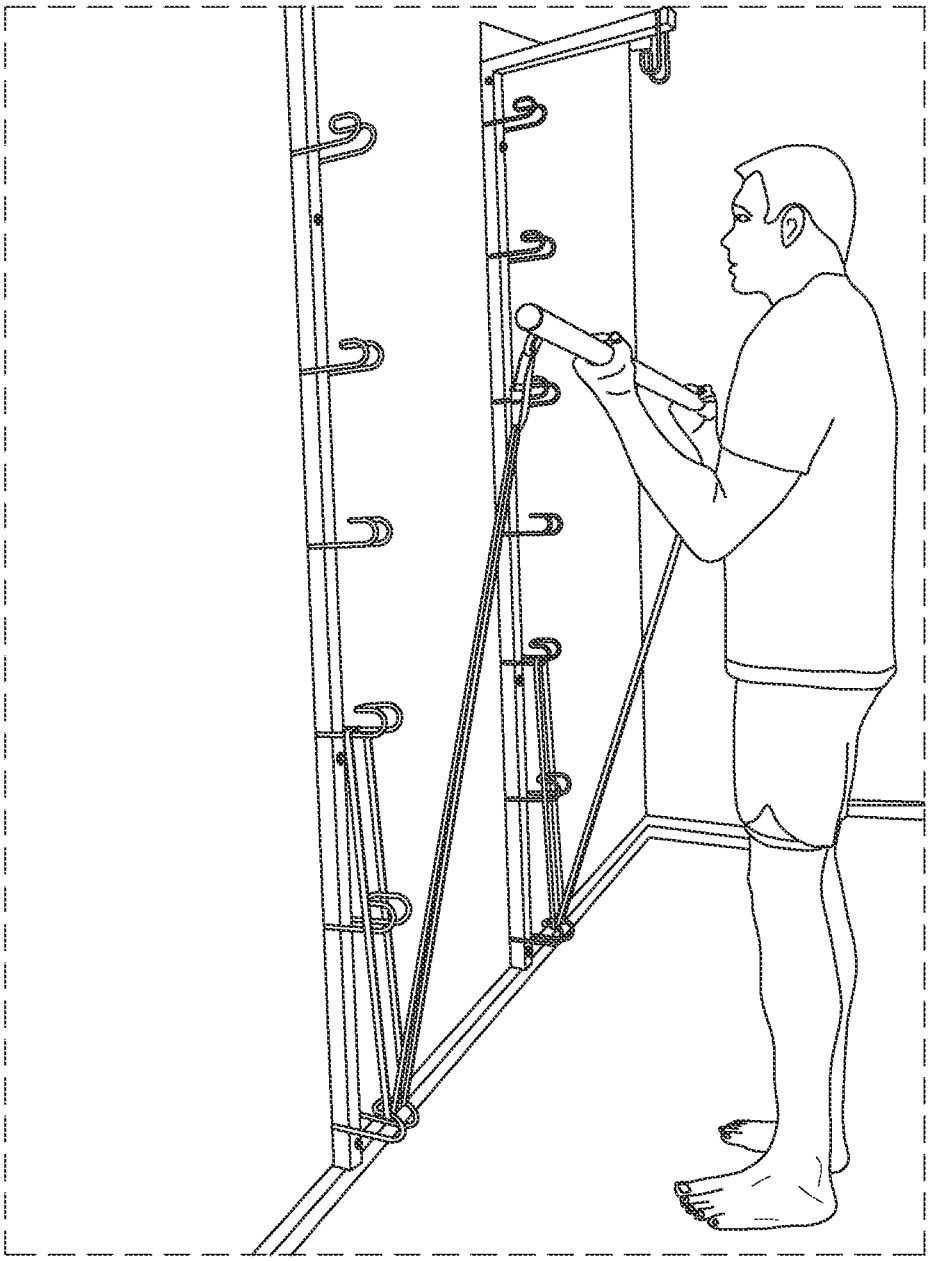
FIG. 6 illustrates a user performing a bar curl exercise on the exercise station.

FIG. 6 illustrates a bar curl exercise whereby a first resistance band 200 and second resistance band 200 are connected to exercise bar 140 by anchor members 142 at one end of resistance bands 200. The other end of resistance bands 200 are hooked on a first vertical loop hook 120, passed over a second vertical loop hook 120, and hooked and rerouted on a third vertical loop hook 120.

Figure 7:
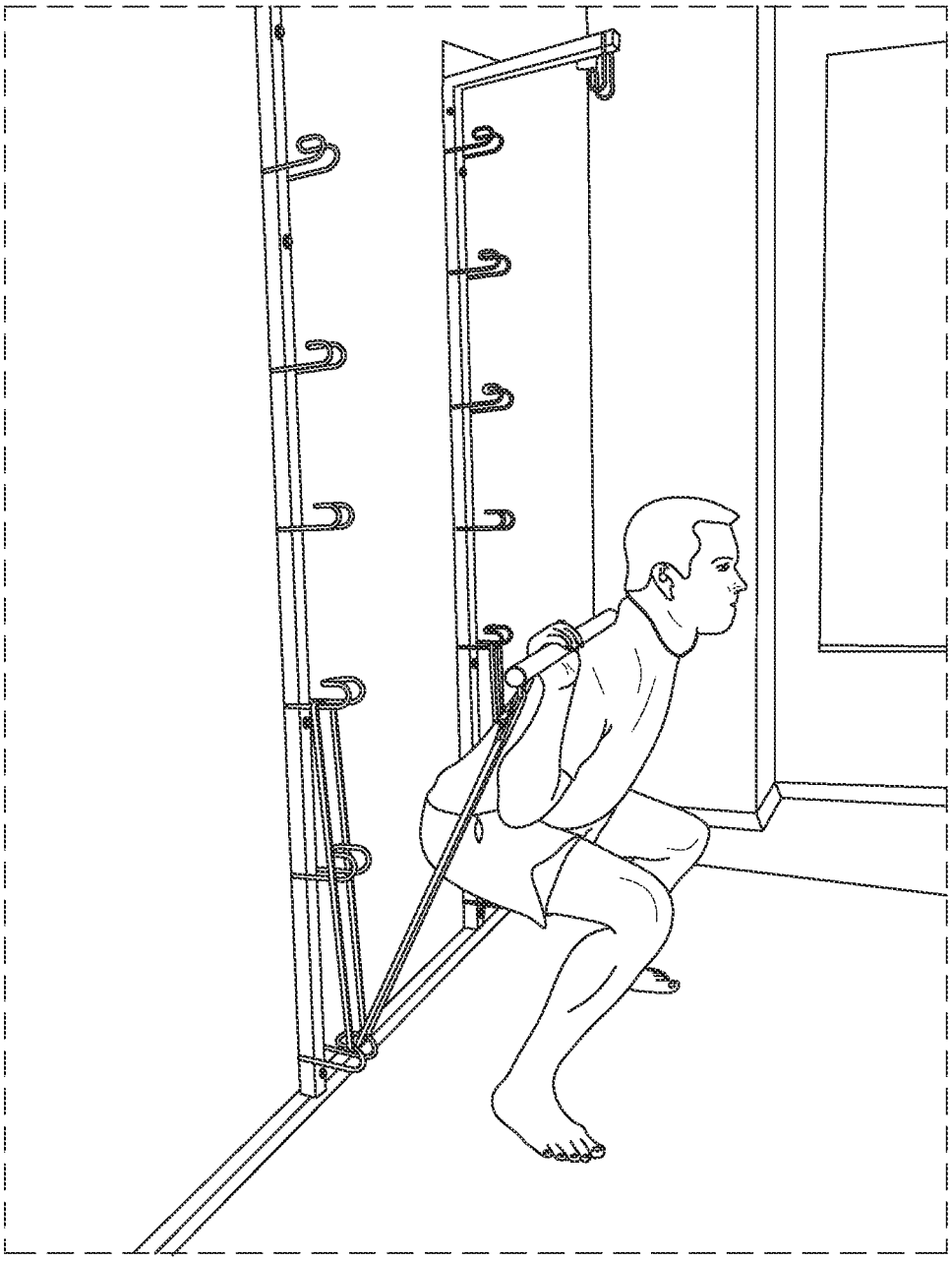
FIG. 7 illustrates a user performing a bar squat exercise on the exercise station.

FIG. 7 illustrates a squat exercise whereby a first resistance band 200 and second resistance band 200 are connected to exercise bar 140 by anchor members 142 at one end of resistance bands 200. The other end of resistance bands 200 are hooked on a first vertical loop hook 120, passed over a second vertical loop hook 120, and hooked and rerouted on a third vertical loop hook 120.

Figure 8:
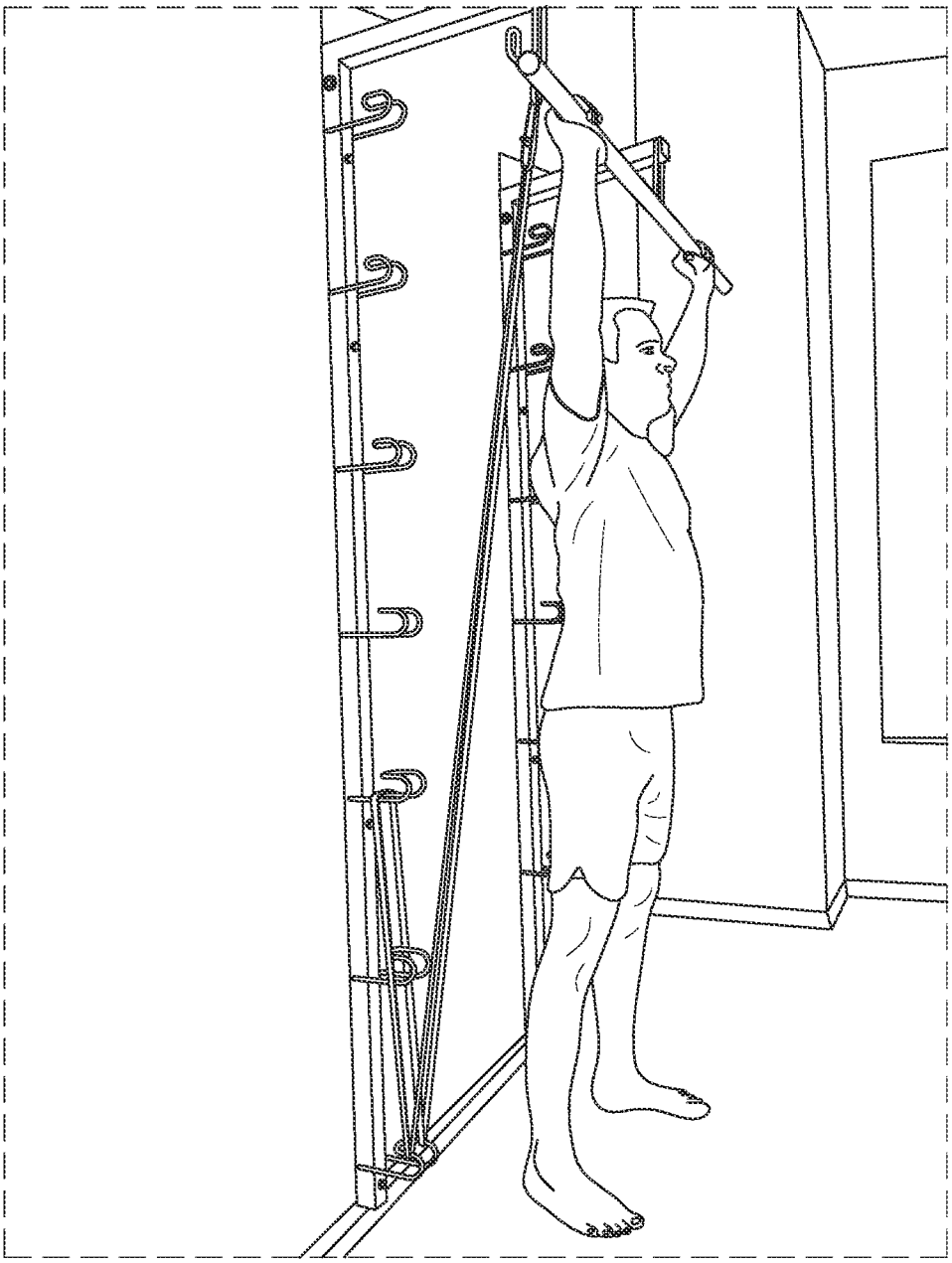
FIG. 8 illustrates a user performing an overhead bar exercise on the exercise station.

FIG. 8 illustrates an overhead press exercise whereby a first resistance band 200 and second resistance band 200 are connected to exercise bar 140 by anchor members 142 at one end of resistance bands 200. The other end of resistance bands 200 are each hooked on a first vertical loop hook 120, passed over a second vertical loop hook 120, and hooked and rerouted on a third vertical loop hook 120.

Figure 9:
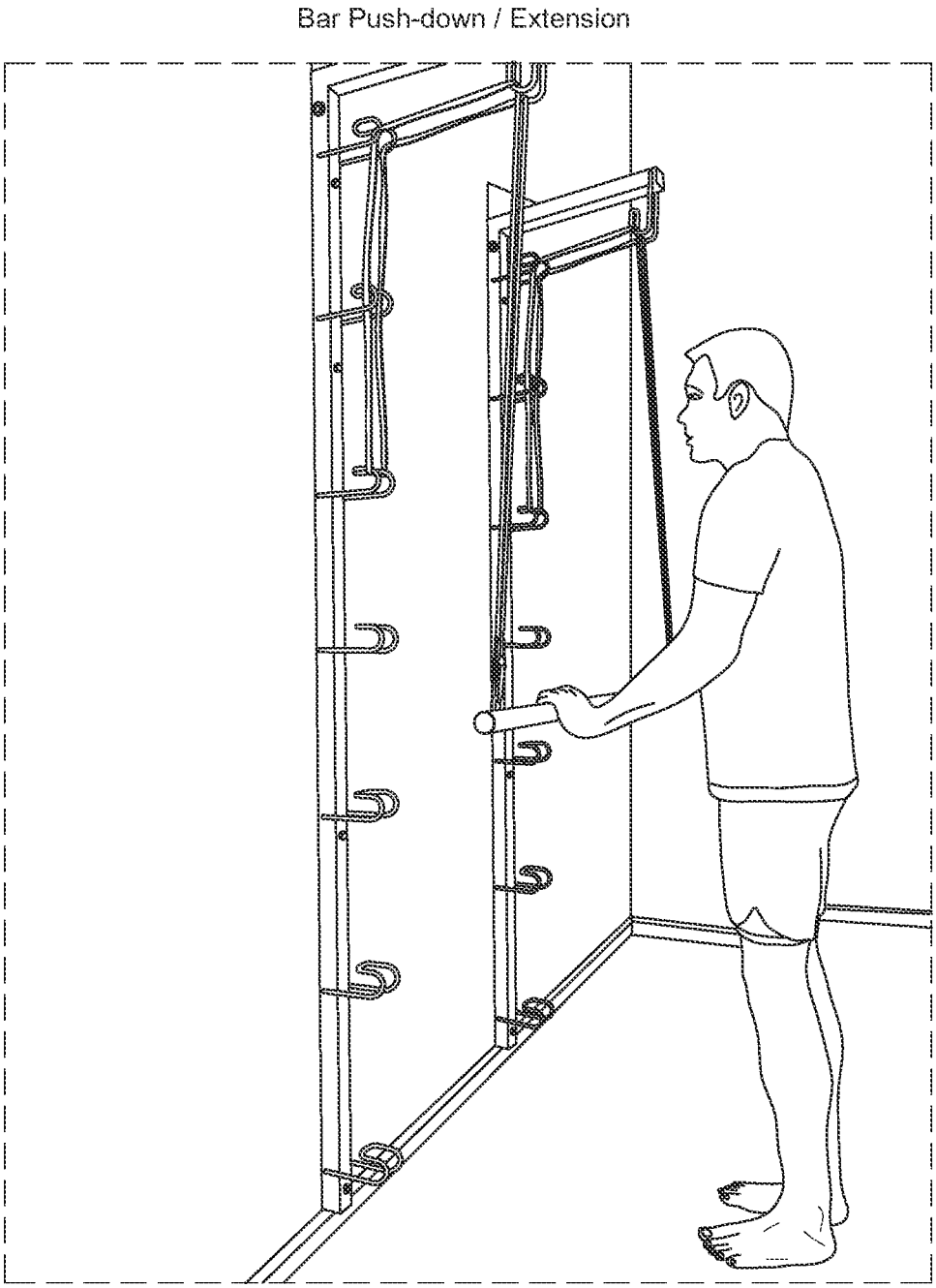
FIG. 9 illustrates a user performing a bar push down press exercise on the exercise station.

FIG. 9 illustrates a bar push down exercise whereby a first resistance band 200 and second resistance band 200 are connected to exercise bar 140 by anchor members 142 at one end of resistance bands 200. The other end of resistance bands 200 are each hooked on a first vertical loop hook 120, passed over a second vertical loop hook 120, hooked and rerouted on a third vertical loop hook 120, then hooked and rerouted on a first horizontal loop hook 130.

Figure 10:
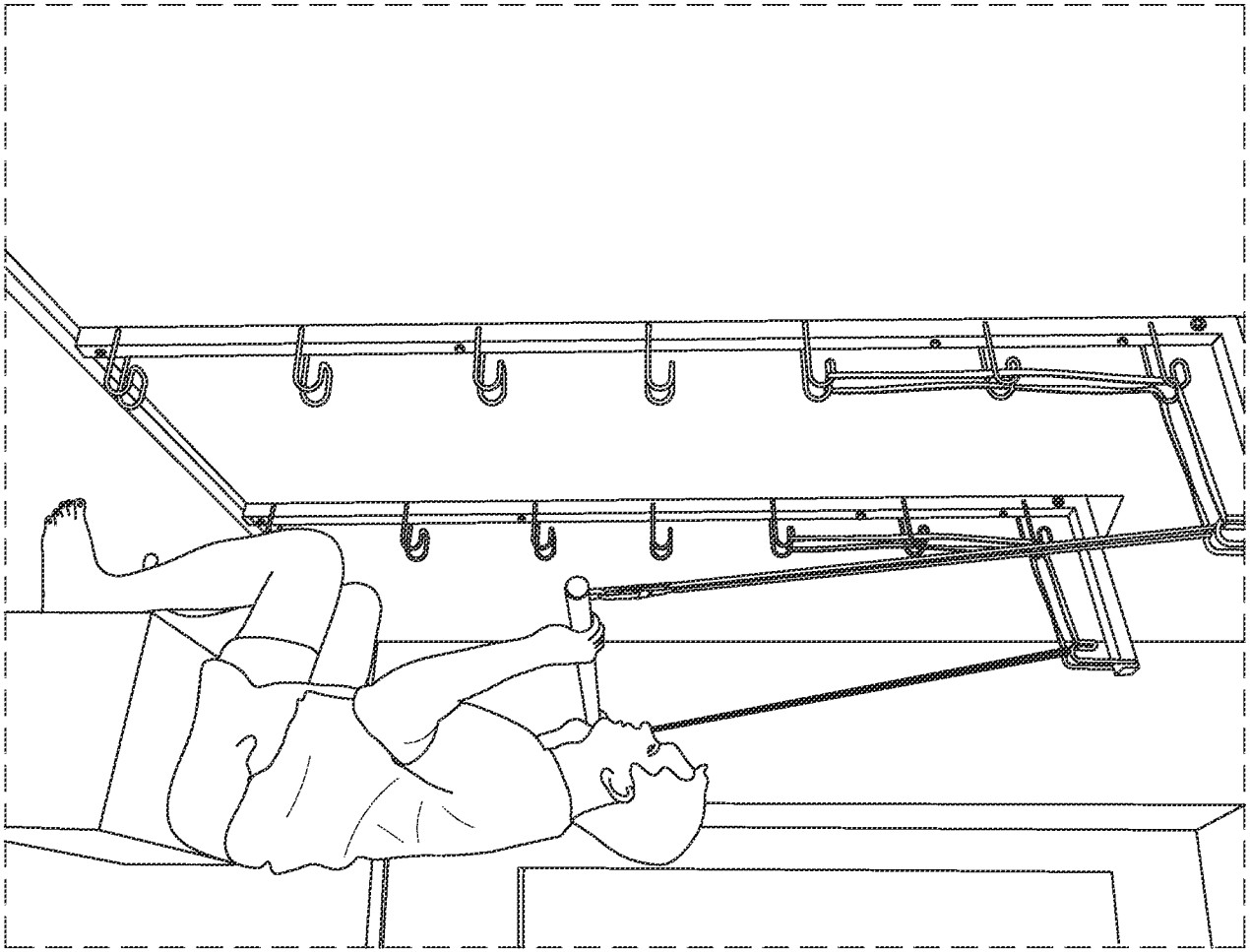
FIG. 10 illustrates a user performing a bar pull down on the exercise station.

FIG. 10 illustrates a bar pull down exercise whereby a first resistance band 200 and second resistance band 200 are connected to exercise bar 140 by anchor members 142 at one end of resistance bands 200. The other end of resistance bands 200 are each hooked on a first vertical loop hook 120, passed over a second vertical loop hook 120, hooked and rerouted on a third vertical loop hook 120, then hooked and rerouted on a first horizontal loop hook 130.

Figure 11:
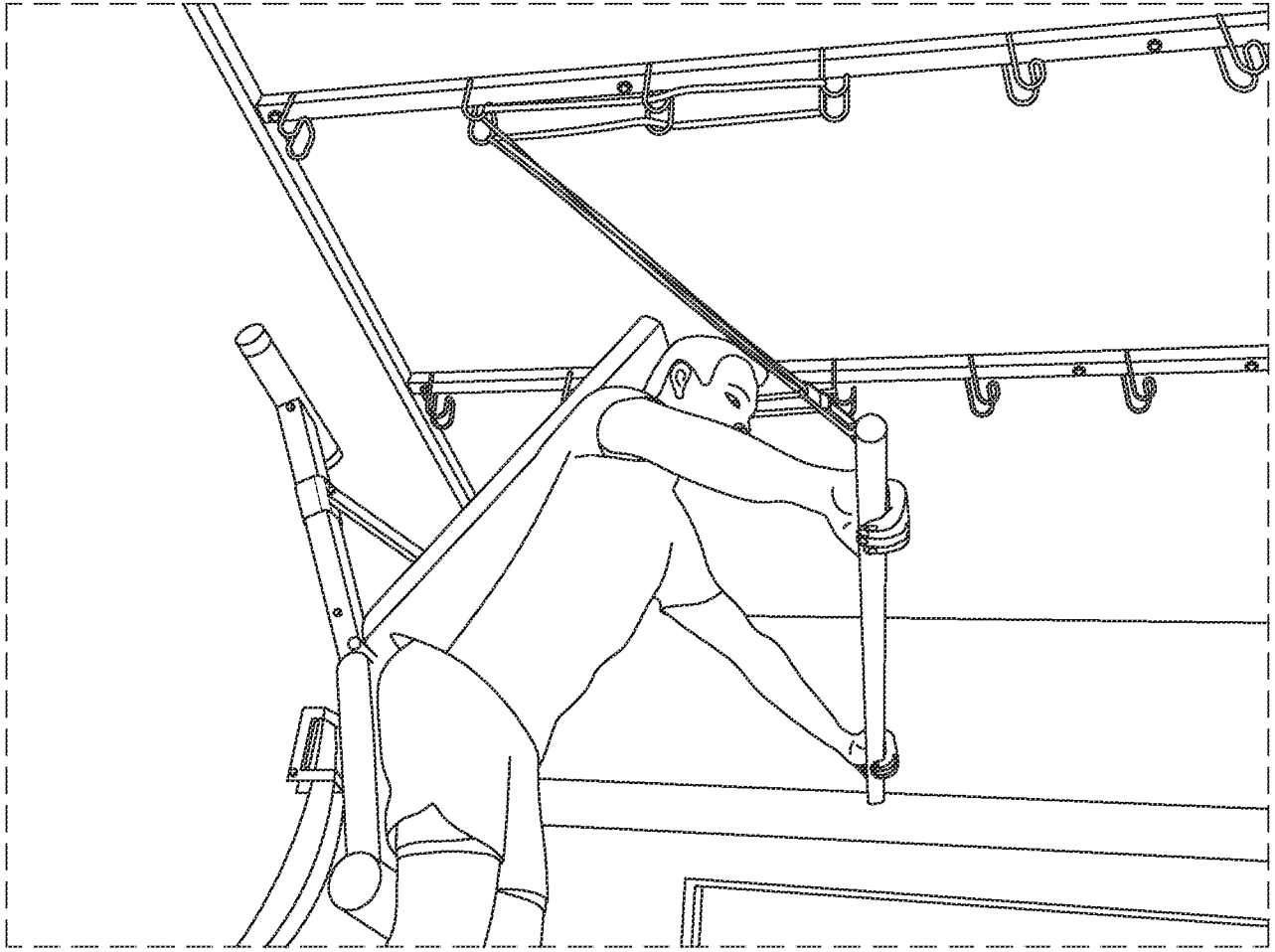
FIG. 11 illustrates a user performing a bar bench press exercise on the exercise station.

FIG. 11 illustrates a bench press exercise whereby a first resistance band 200 and second resistance band 200 are connected to exercise bar 140 by anchor members 142 at one end of resistance bands 200. The other end of resistance bands 200 are each hooked on a first vertical loop hook 120, passed over a second vertical loop hook 120, and hooked and rerouted on a third vertical loop hook 120.

Figure 12:
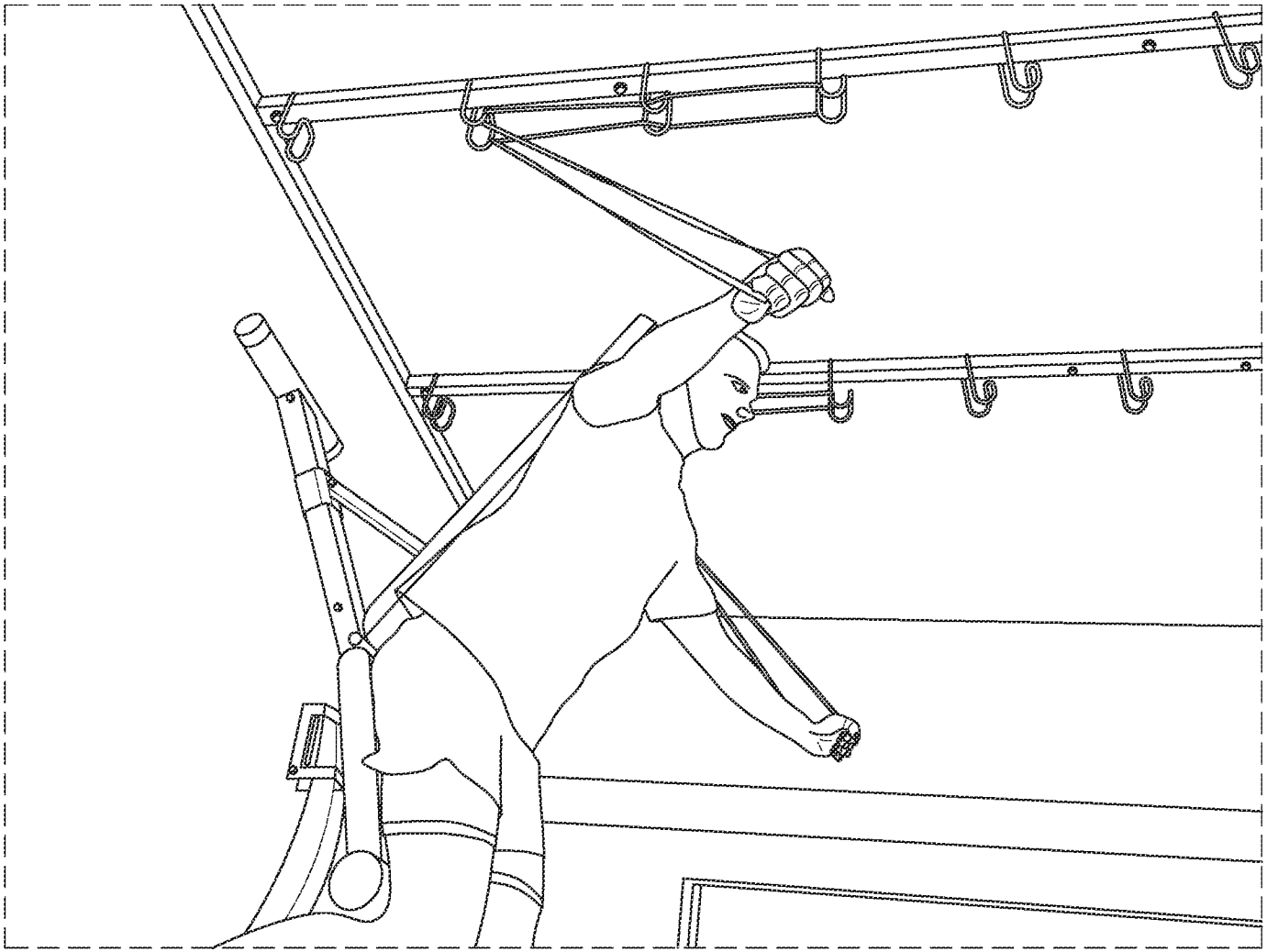
FIG. 12 illustrates a user performing lying band flyes on the exercise station.

FIG. 12 illustrates a lying band fly exercise whereby resistance bands 200 are each hooked on a first vertical loop hook 120, passed over a second vertical loop hook 120, and hooked and rerouted on a third vertical loop hook 120.

Figure 13:
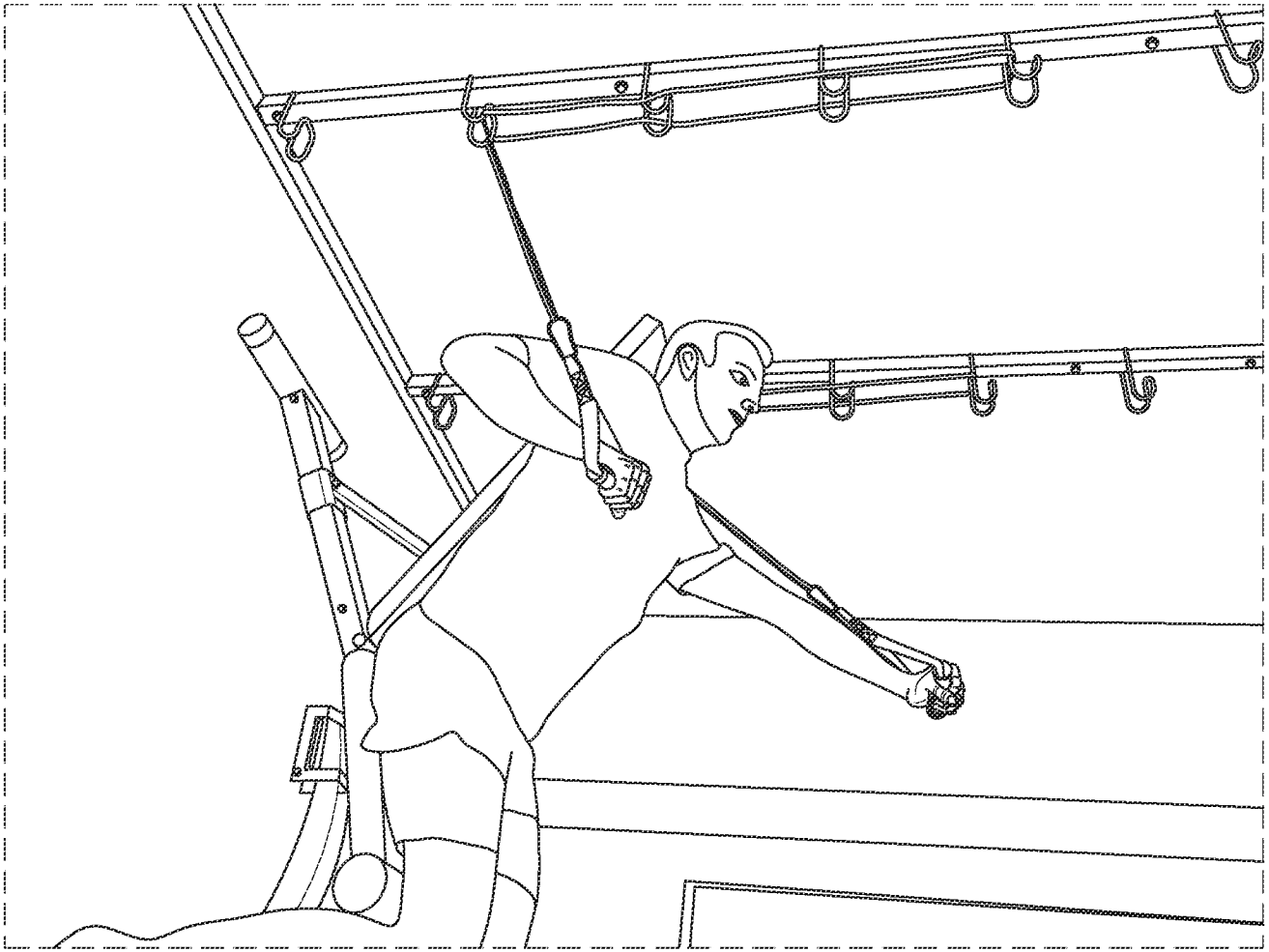
FIG. 13 illustrates a user performing a lying band one-hand press exercise on the exercise station.

FIG. 13 illustrates a lying one hand press exercise whereby resistance bands 200 are each hooked on a first vertical loop hook 120, passed over a second vertical loop hook 120, passed over a third vertical loop hook 120, and hooked and rerouted on a fourth vertical loop hook 120.

Figure 14:
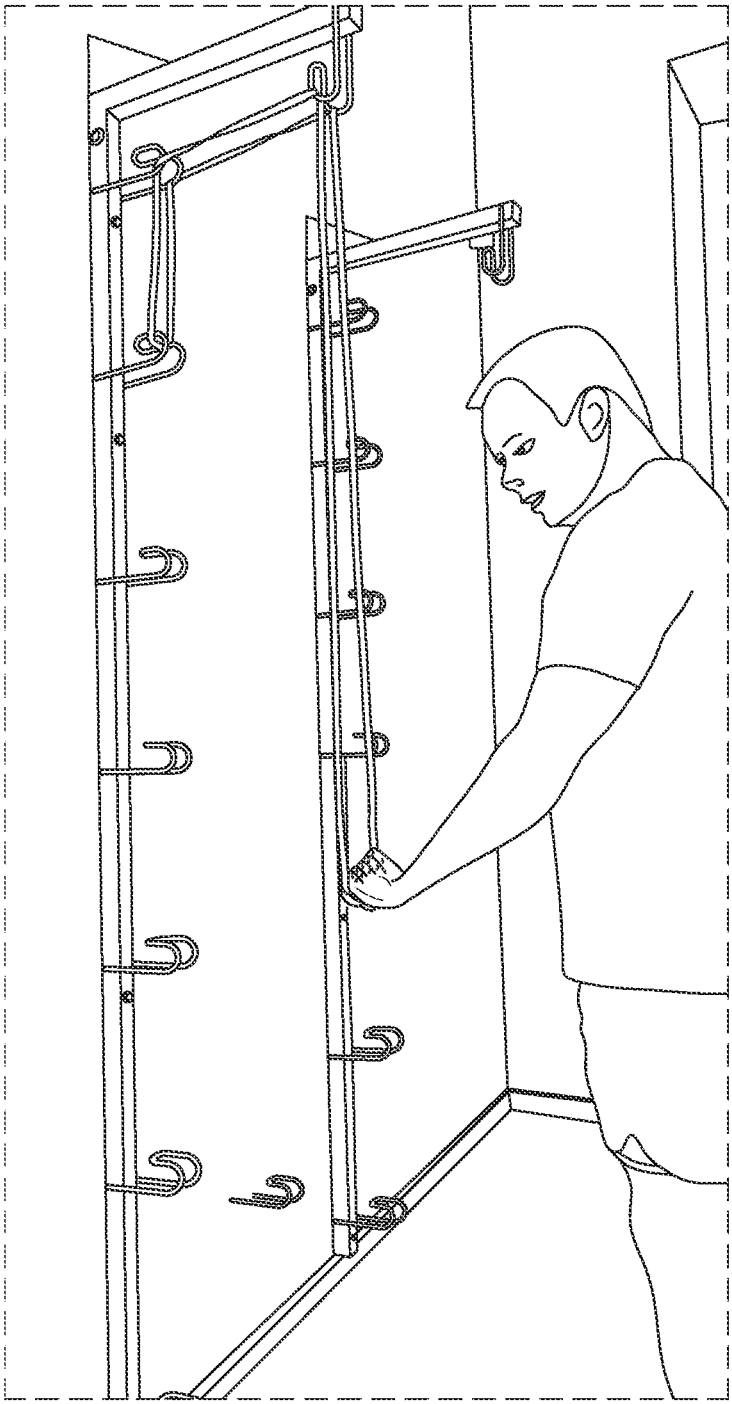
FIG. 14 illustrates a user performing a one arm extension exercise on the exercise station.

FIG. 14 illustrates a one arm extension exercise whereby a first resistance band 200 is hooked on a first vertical loop hook 120, hooked and rerouted on a second vertical loop hook 120, then hooked and rerouted on a first horizontal loop hook 130.

Figure 15:
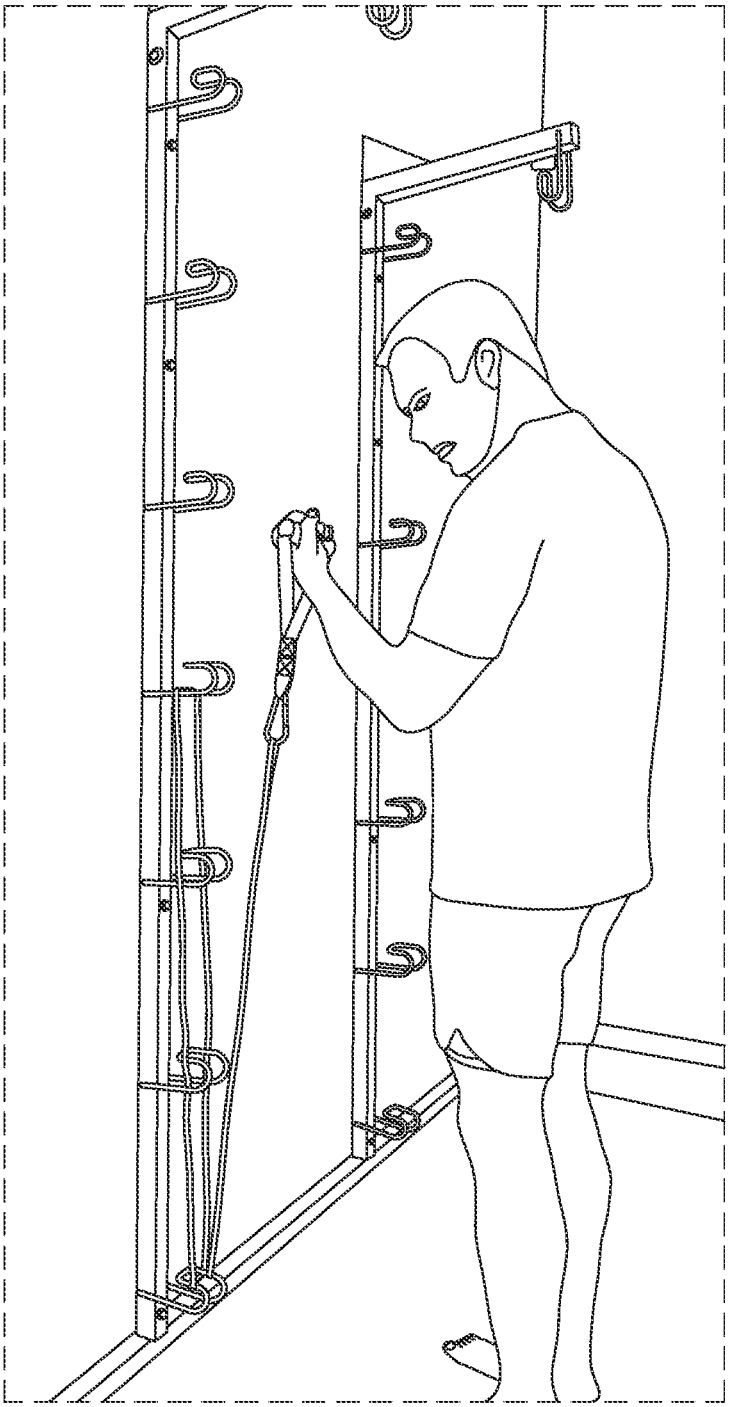
FIG. 15 illustrates a user performing a one arm curl exercise with a handle on the exercise station.

FIG. 15 illustrates a lying one arm curl exercise whereby a resistance band 200 is hooked on a first vertical loop hook 120, passed over a second vertical loop hook 120, passed over a third vertical loop hook 120, and hooked and rerouted on a fourth vertical loop hook 120, whereby the resistance band is connected to an accessory handle 300.

Figure 16:
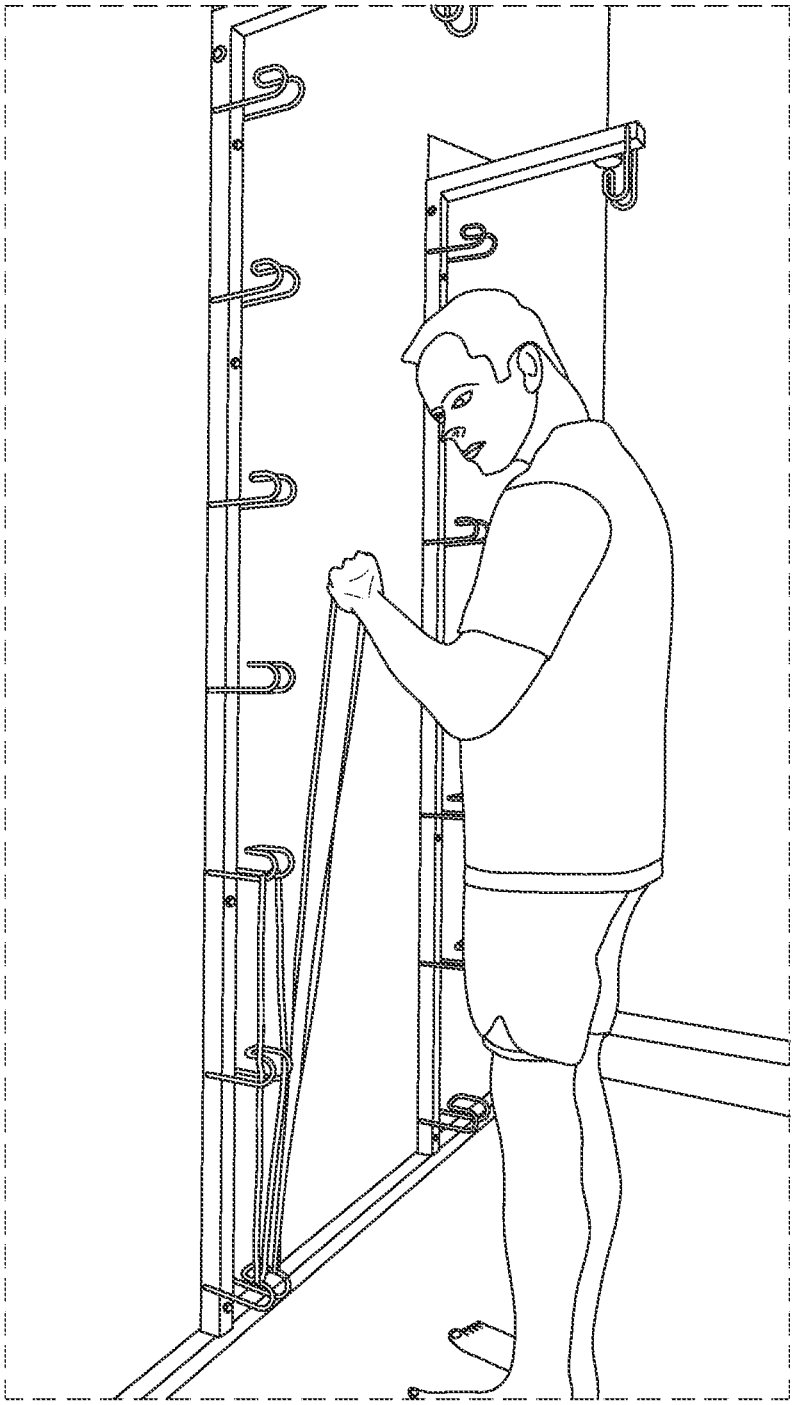
FIG. 16 illustrates a user performing a one arm curl exercise without a handle on the exercise station.
Figure 21:
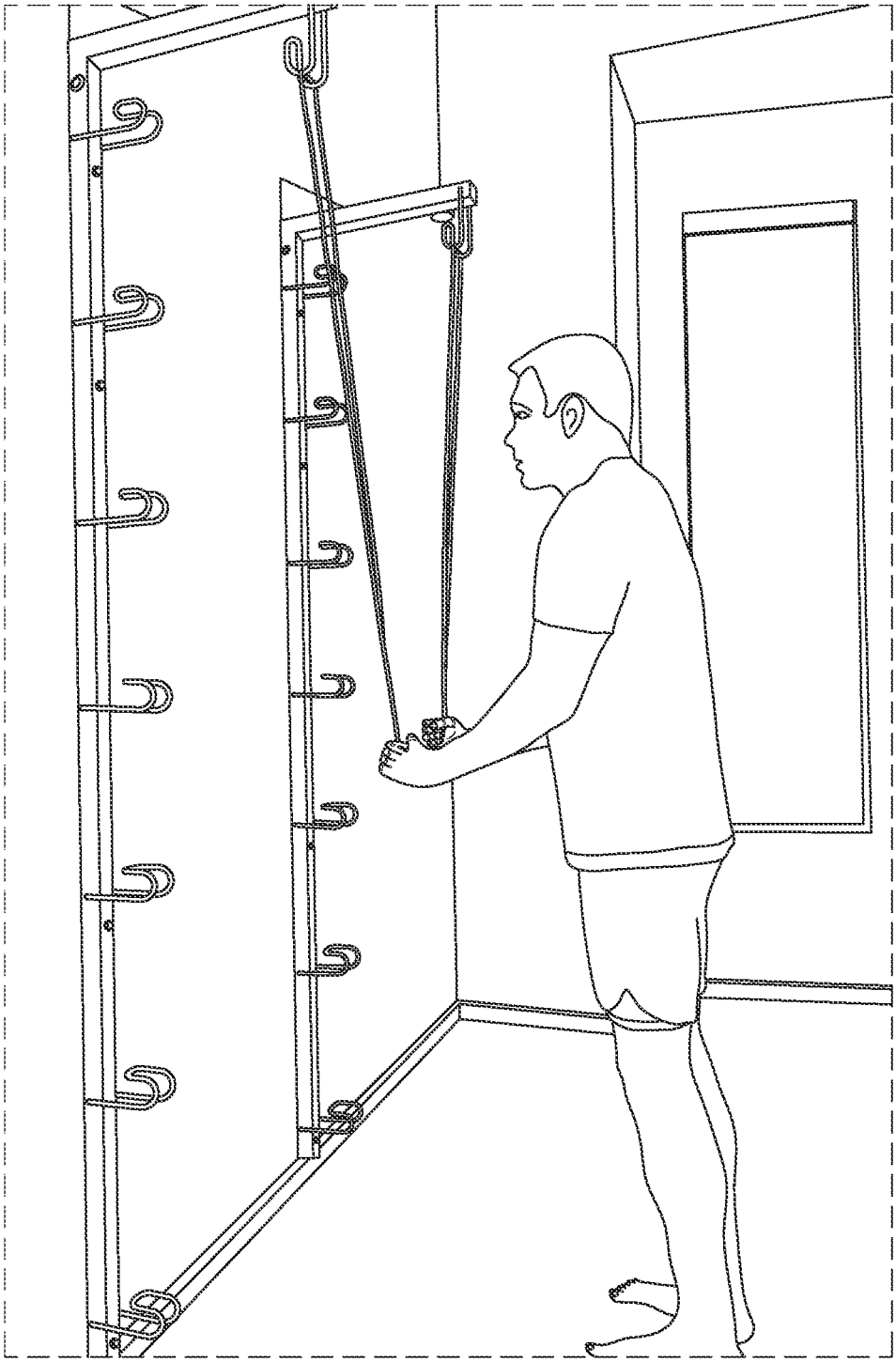
FIG. 21 illustrates a user performing a reserves grip tricep extension exercise on the exercise station.

FIG. 16 illustrates a one arm curl exercise whereby a resistance band 200 is hooked on a first vertical loop hook 120, passed over a second vertical loop hook 120, passed over a third vertical loop hook 120, and hooked and rerouted on a fourth vertical loop hook 120, whereby the resistance band is connected to an accessory handle 300. FIG. 21 illustrates a one arm curl exercise without the handle.

Figure 17:
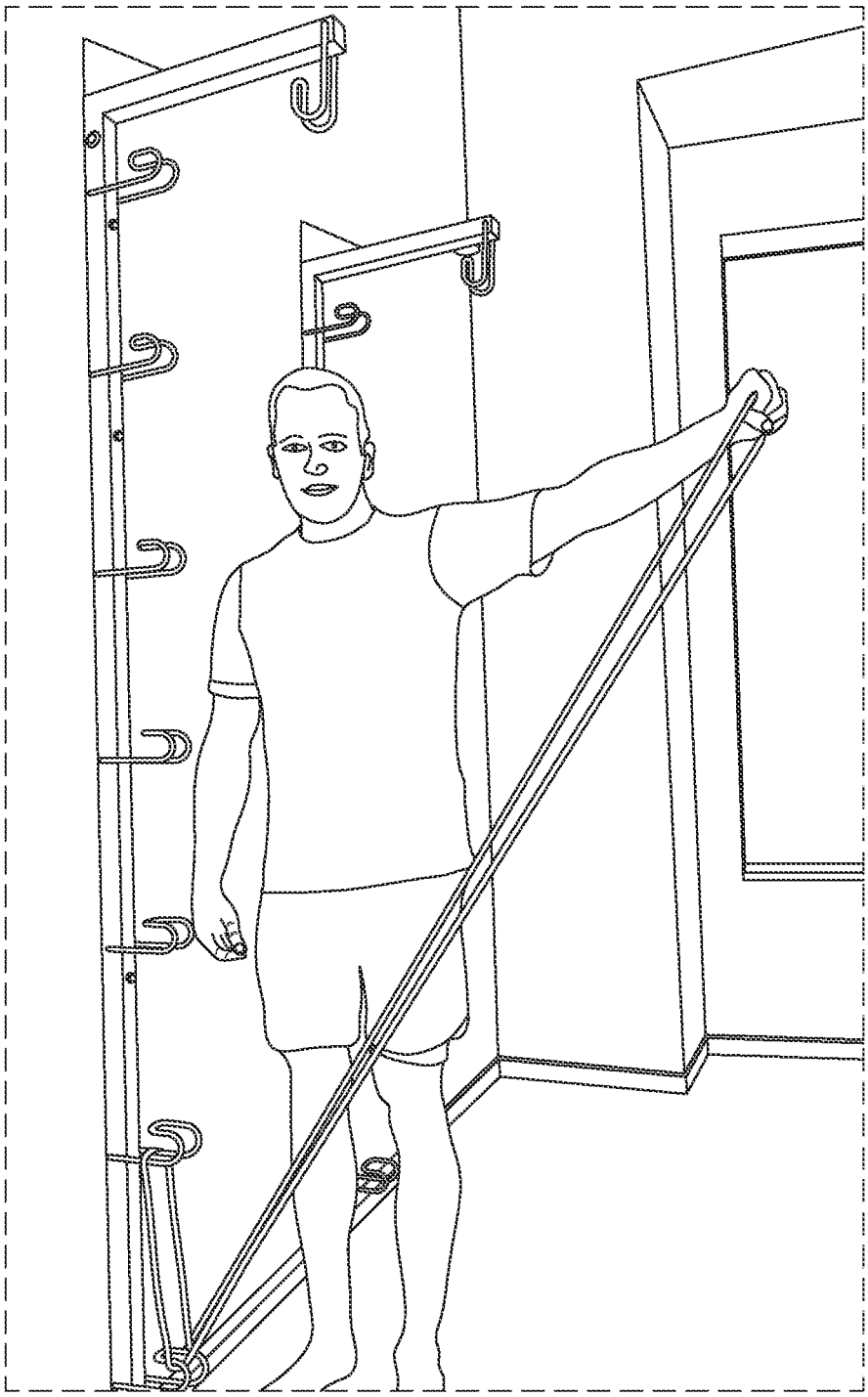
FIG. 17 illustrates a user performing a one arm lateral extension on the exercise station.

FIG. 17 illustrates a one arm lateral extension exercise whereby a resistance band 200 is hooked on a first vertical loop hook 120 and hooked and rerouted on a second vertical loop hook 120.

Figure 18:
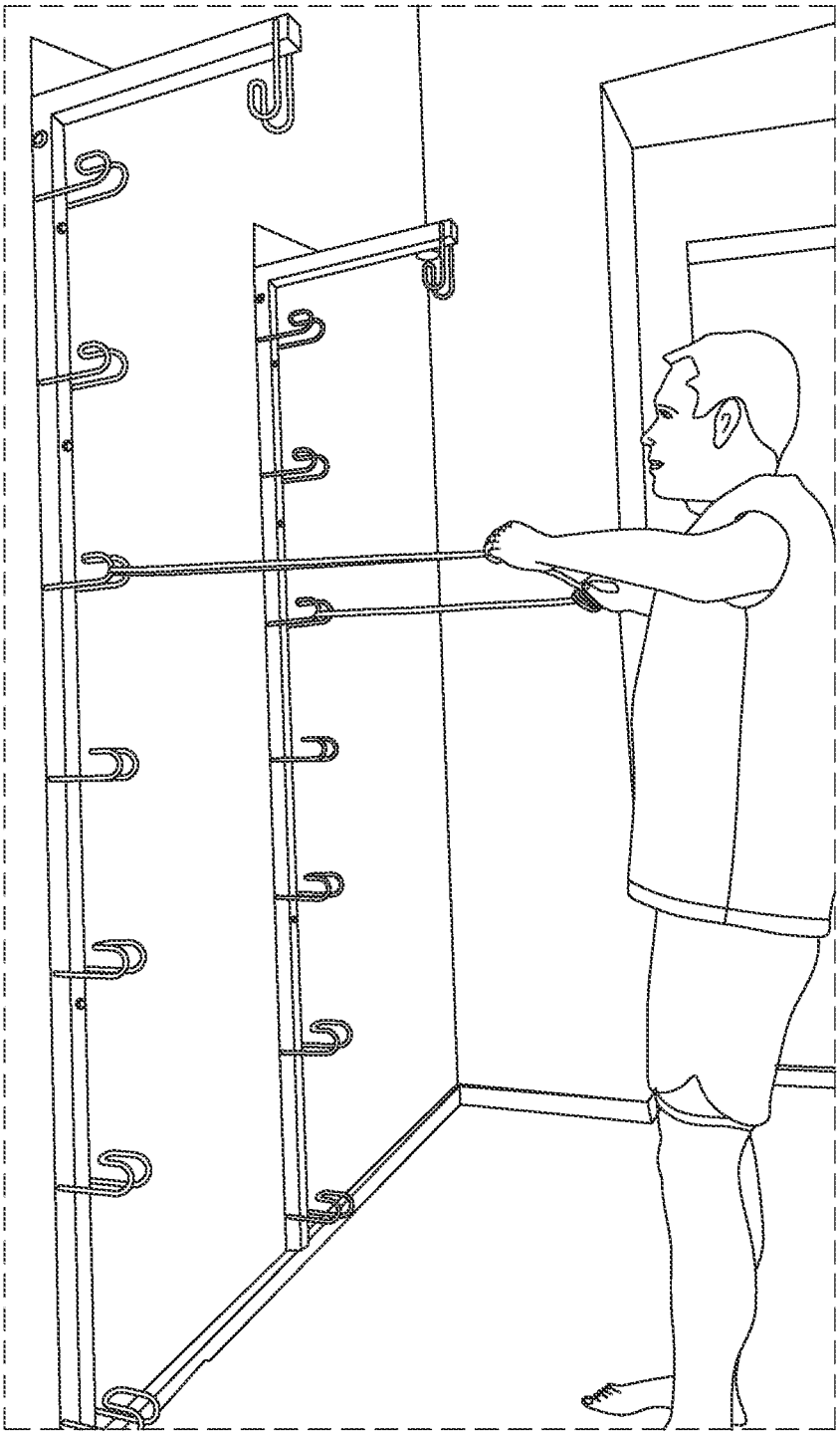
FIG. 18 illustrates a user performing a rear delt row exercise on the exercise station.

FIG. 18 illustrates a rear delt row exercise whereby a resistance band 200 is hooked on a first vertical loop hook 120 and hooked on a second vertical loop hook 120 on opposite vertical members 112.

Figure 19:
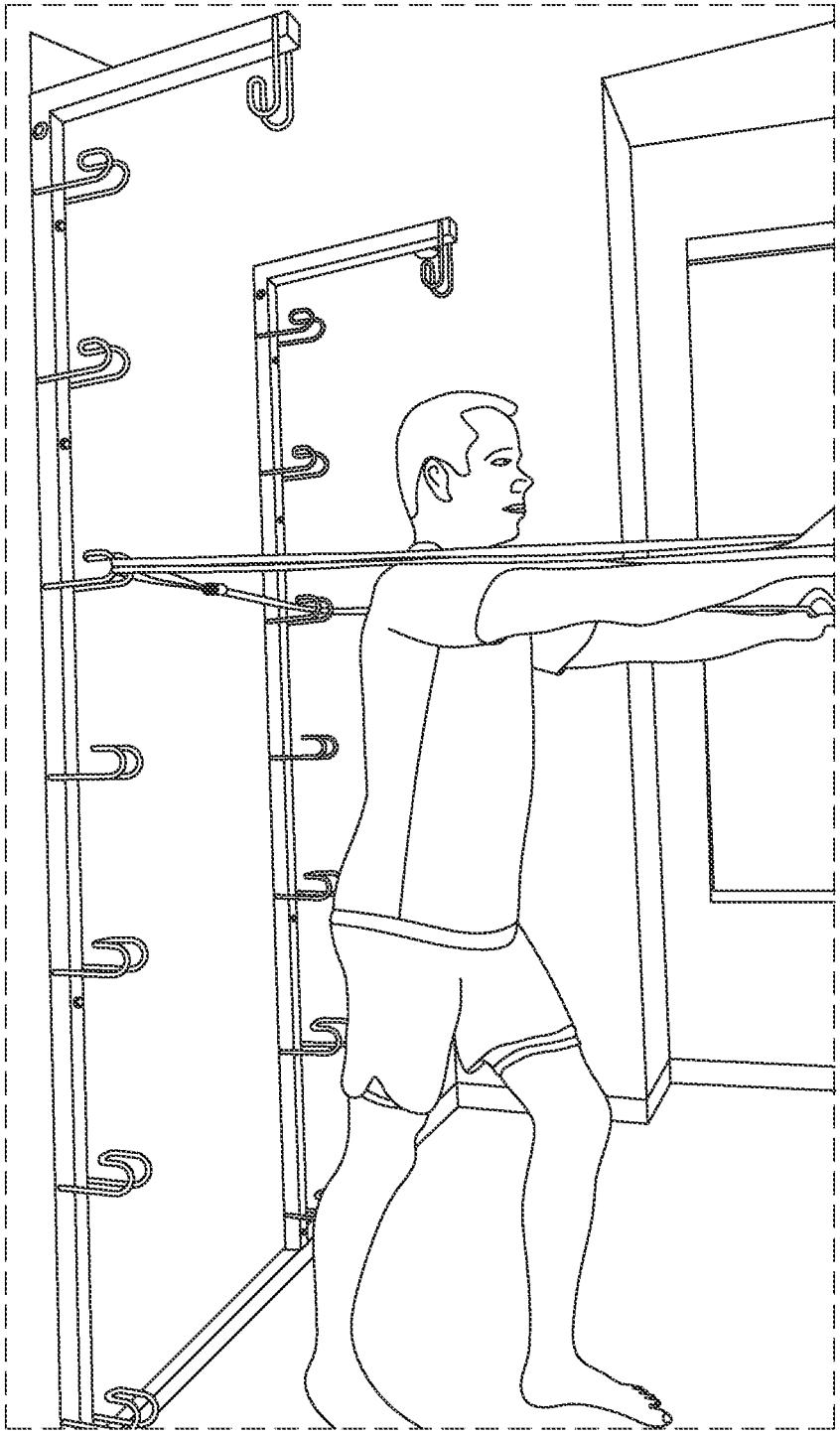
FIG. 19 illustrates a user performing a standing chesty fly exercise on the exercise station.

FIG. 19 illustrates a standing chest fly exercise whereby a resistance band 200 is hooked on a first vertical loop hook 120 and hooked on a second vertical loop hook 120 on opposite vertical members 112.

Figure 20:
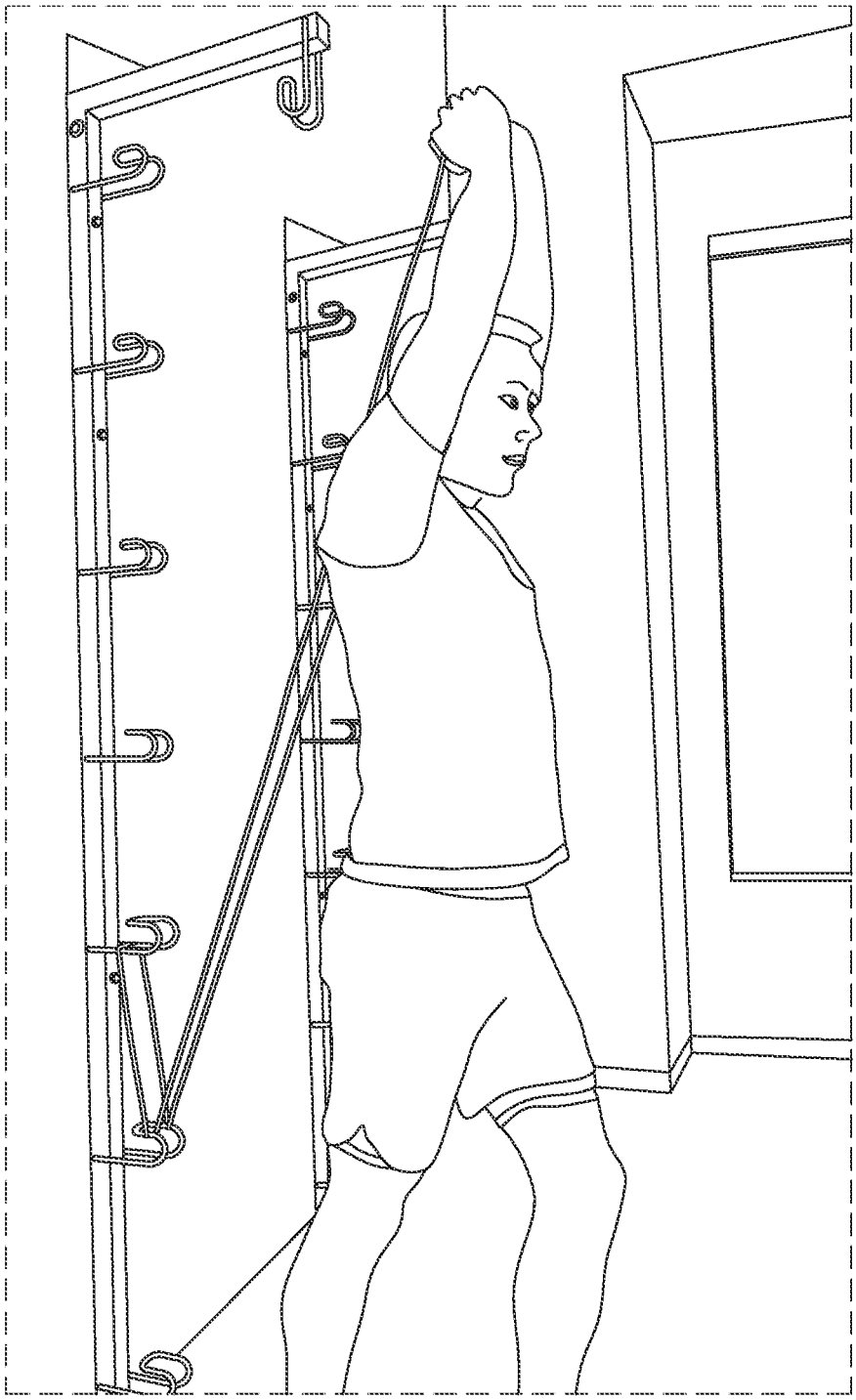
FIG. 20 illustrates a user performing an overhead tricep extension exercise on the exercise station.

FIG. 20 illustrates an overhead triceps extension exercise whereby a resistance band 200 is hooked on a first vertical loop hook 120 and hooked and rerouted on a second vertical loop hook 120.

FIG. 21 illustrates a standing chest fly exercise whereby a resistance band 200 is hooked on a first horizontal loop hook 130 and hooked on a second horizontal loop hook 130 on opposite horizontal members 114.

Figure 22:
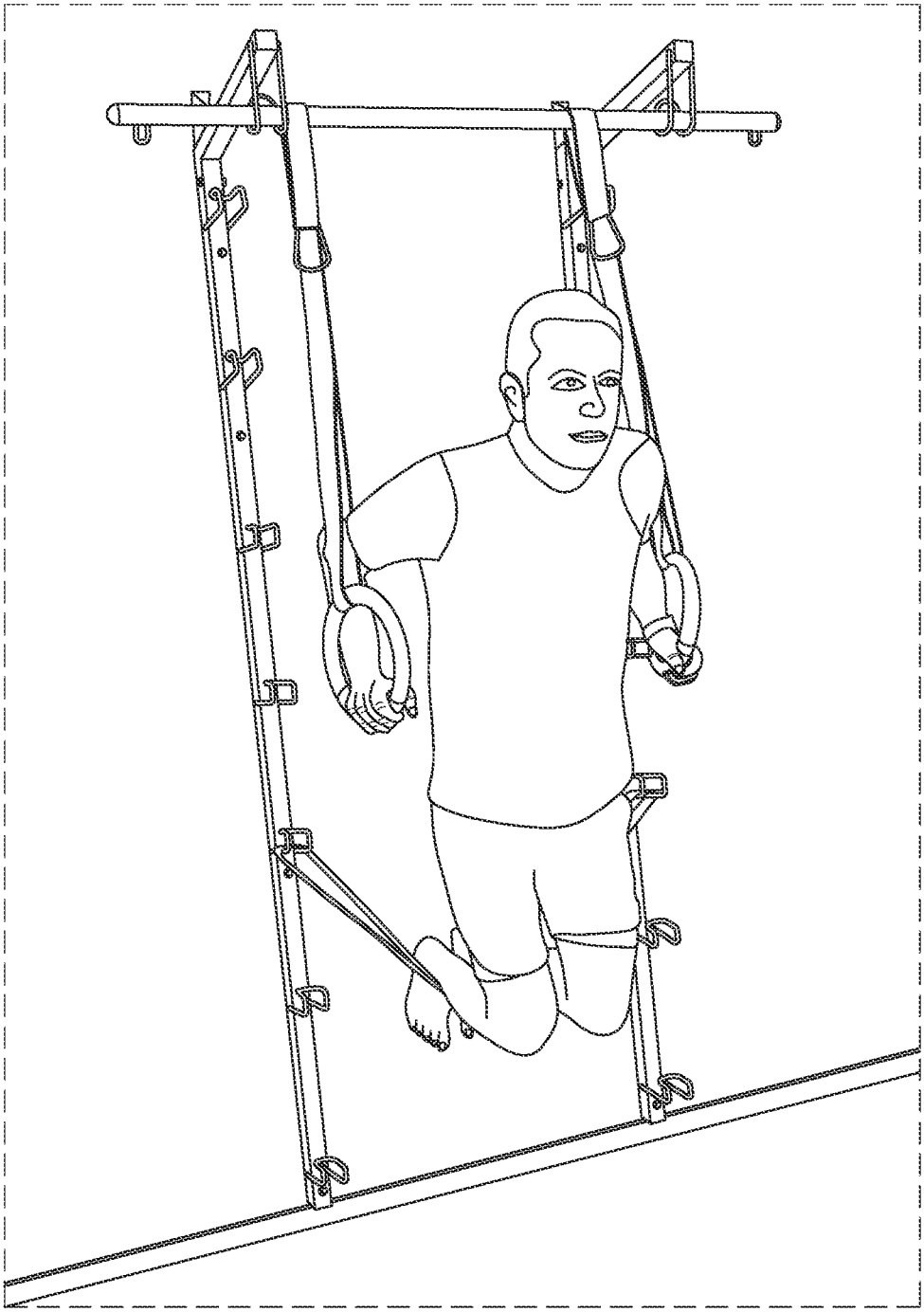
FIG. 22 illustrates a user performing a ring chest dip exercise on the exercise station.

FIG. 22 illustrates a ring chest press exercise whereby a resistance band 200 is hooked on a first vertical loop hook 120 and hooked on a second vertical loop hook 120 on opposite vertical members 112 whereby ring accessories 600 are connected to horizontal member 114 by one or more straps 620.

Figure 23:
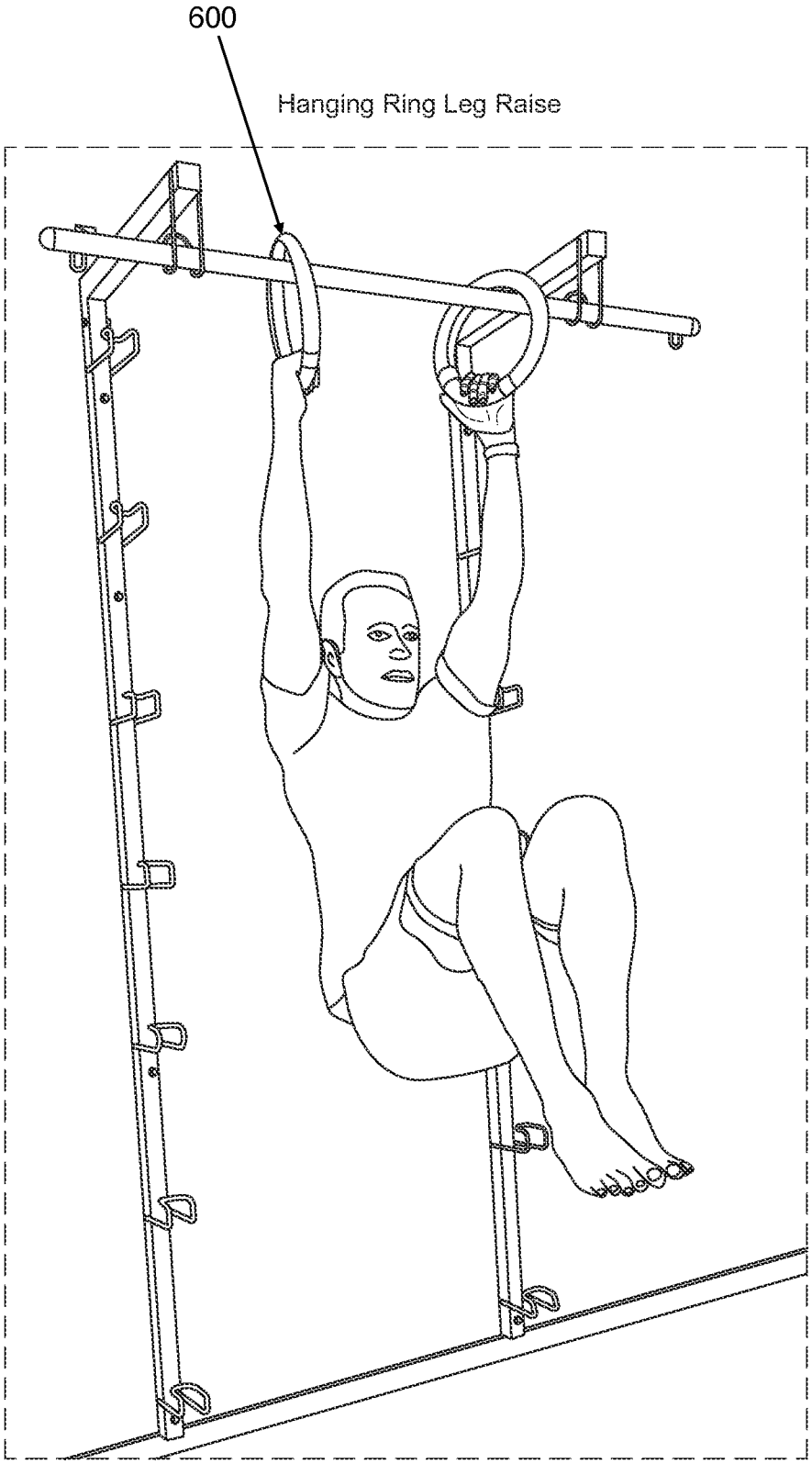
FIG. 23 illustrates a user performing a hanging ring leg raise exercise on the exercise station.

FIG. 23 illustrates a hanging ring leg raise exercise whereby ring accessories 600 are connected to horizontal member 114.

Figure 24:
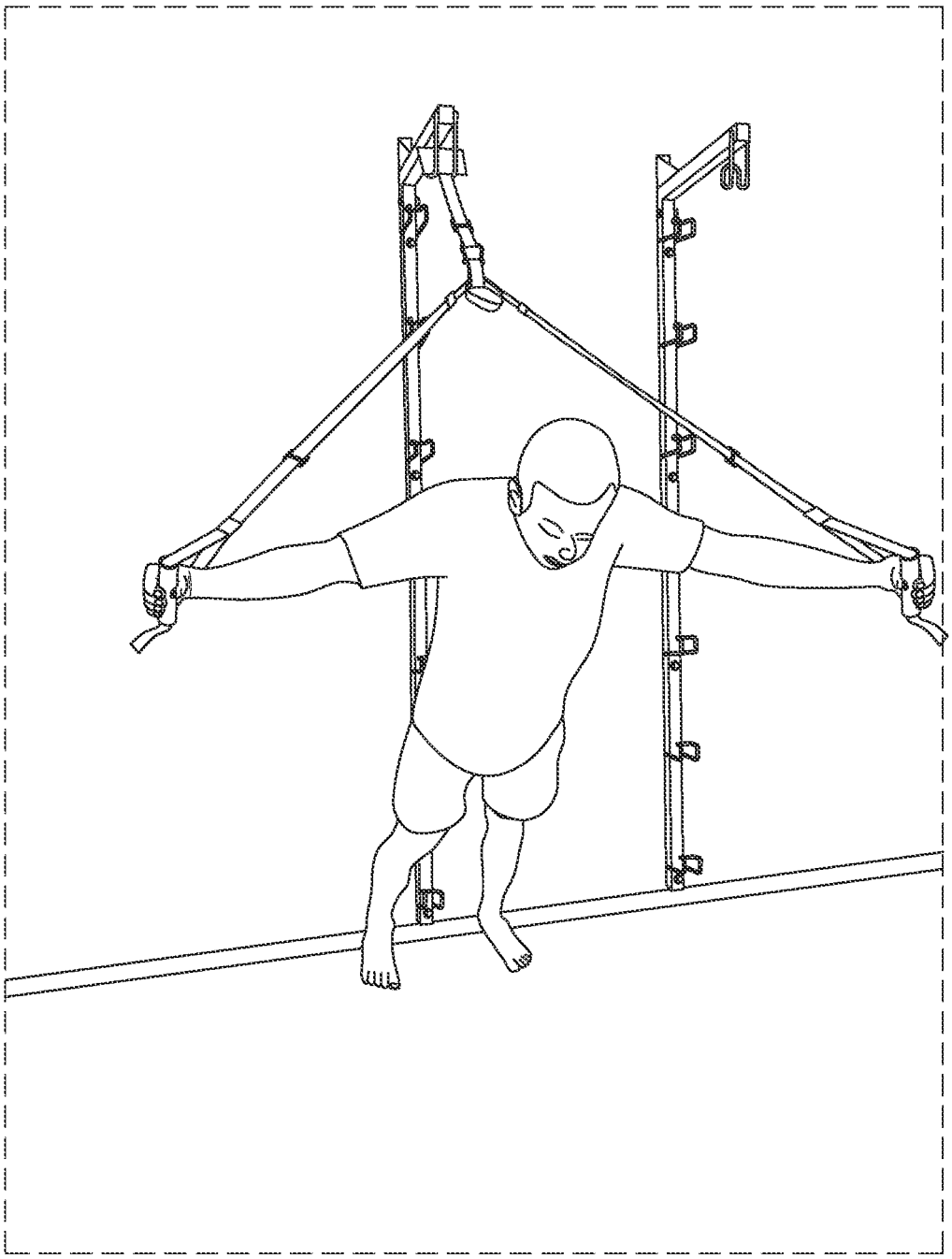
FIG. 24 illustrates a user performing a suspension chest fly exercise on the exercise station.

FIG. 24 illustrates a suspension chest fly exercise whereby a TRX 700 is connected to a horizontal loop hook 130.

Figure 25:
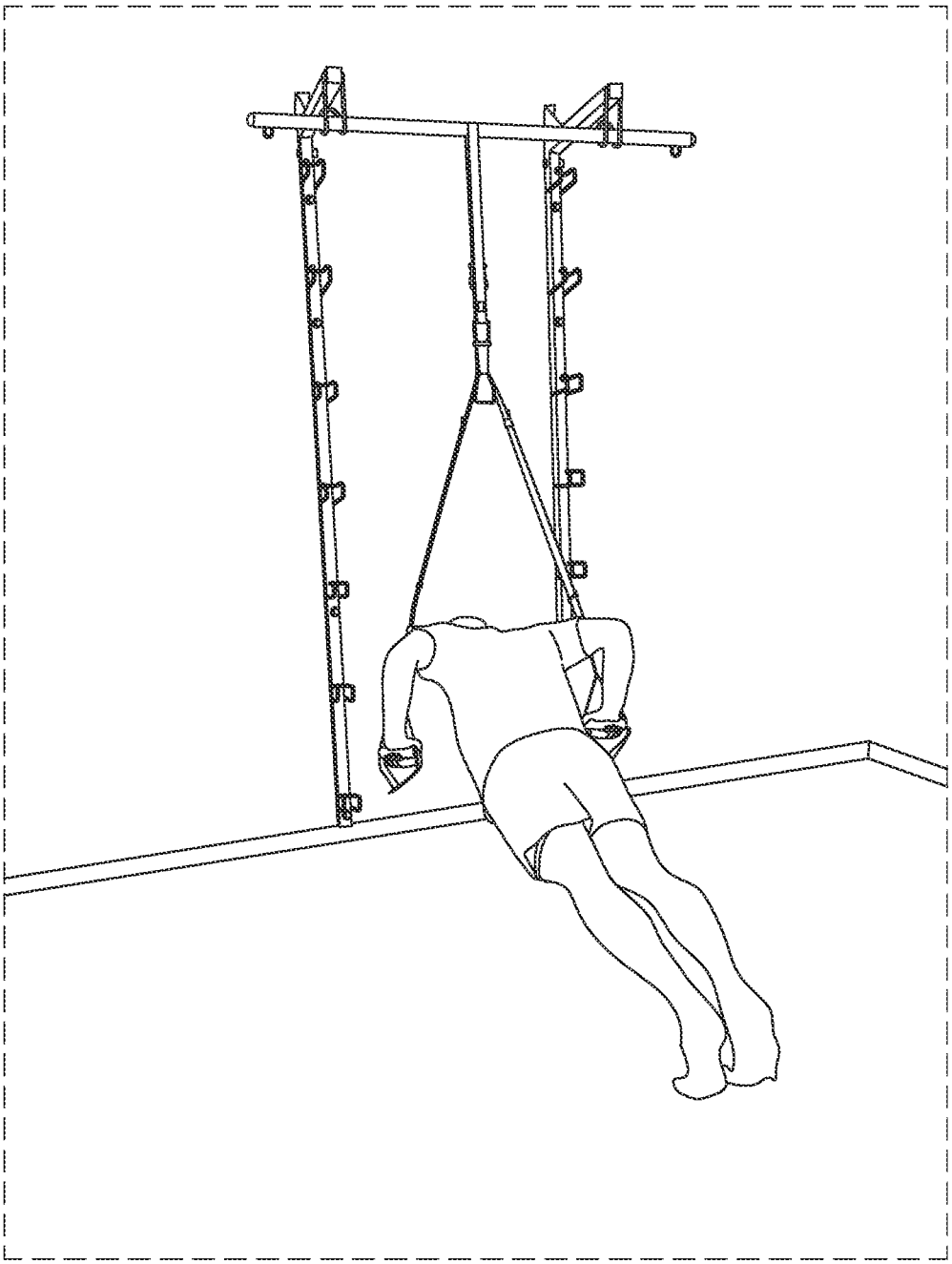
FIG. 25 illustrates a user performing a suspension push-up exercise on the exercise station.

FIG. 25 illustrates a suspension push-up exercise whereby a TRX 700 is connected to exercise bar 140 positioned in horizontal loop hooks 130.

Figure 26:
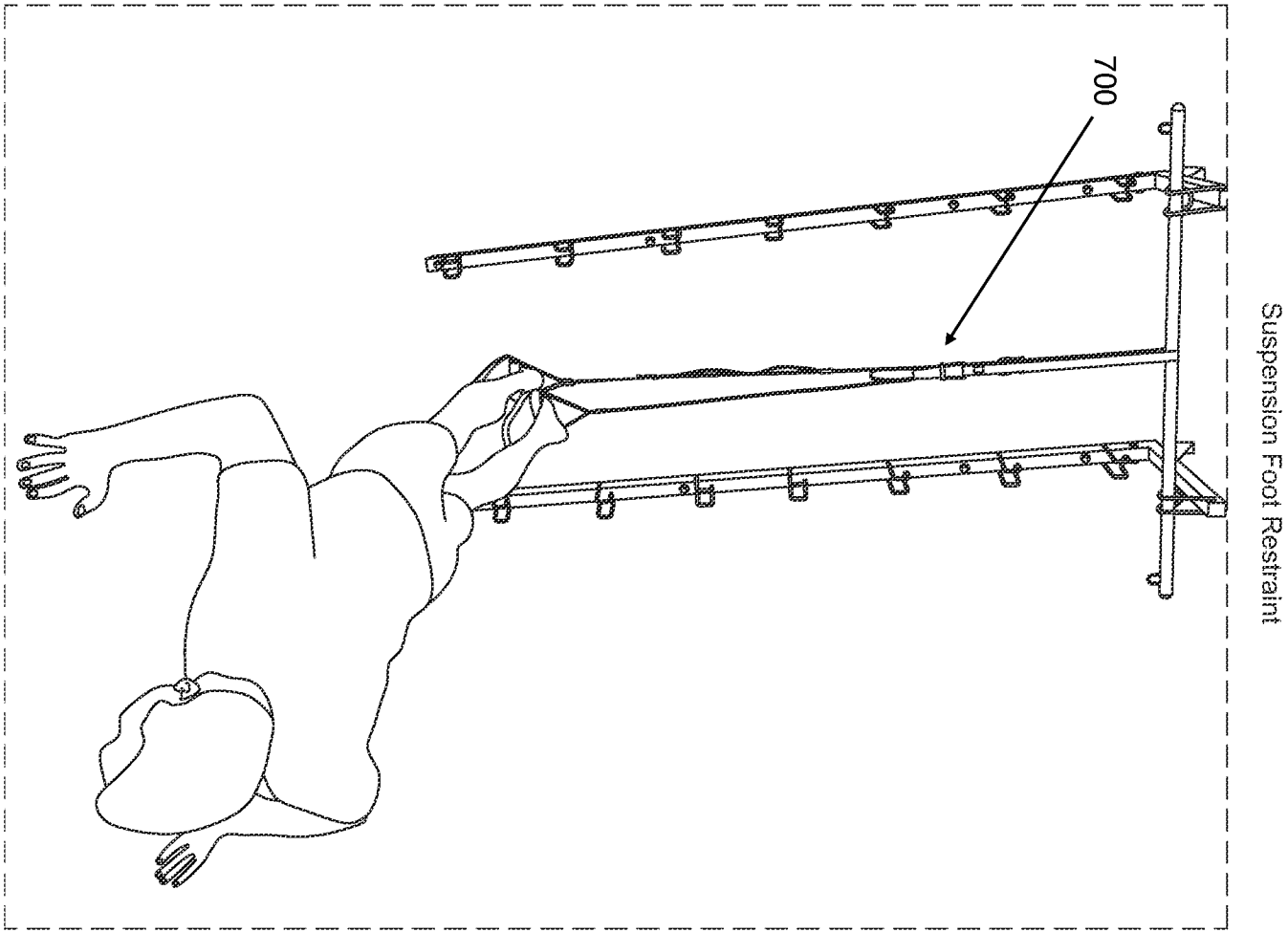
FIG. 26 illustrates a user performing a suspension foot restraint exercise on the exercise station.

FIG. 26 illustrates a suspension foot restraint exercise whereby a TRX 700 is connected to exercise bar 140 positioned in horizontal loop hooks 130.

Figure 27:
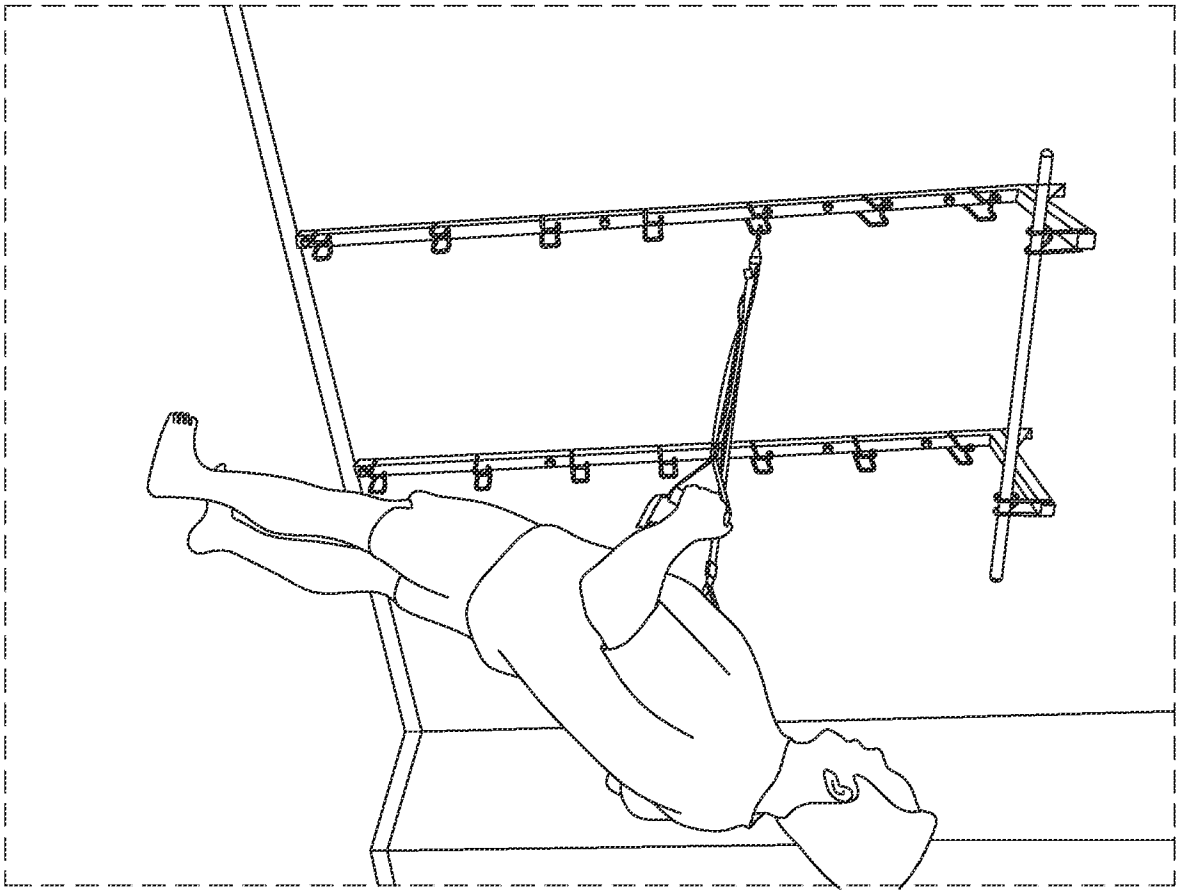
FIG. 27 illustrates a user performing a suspension lat row on the exercise station.

FIG. 27 illustrates a suspension chest fly exercise whereby a TRX 700 is connected to a vertical loop hook 120.

Figure 28:
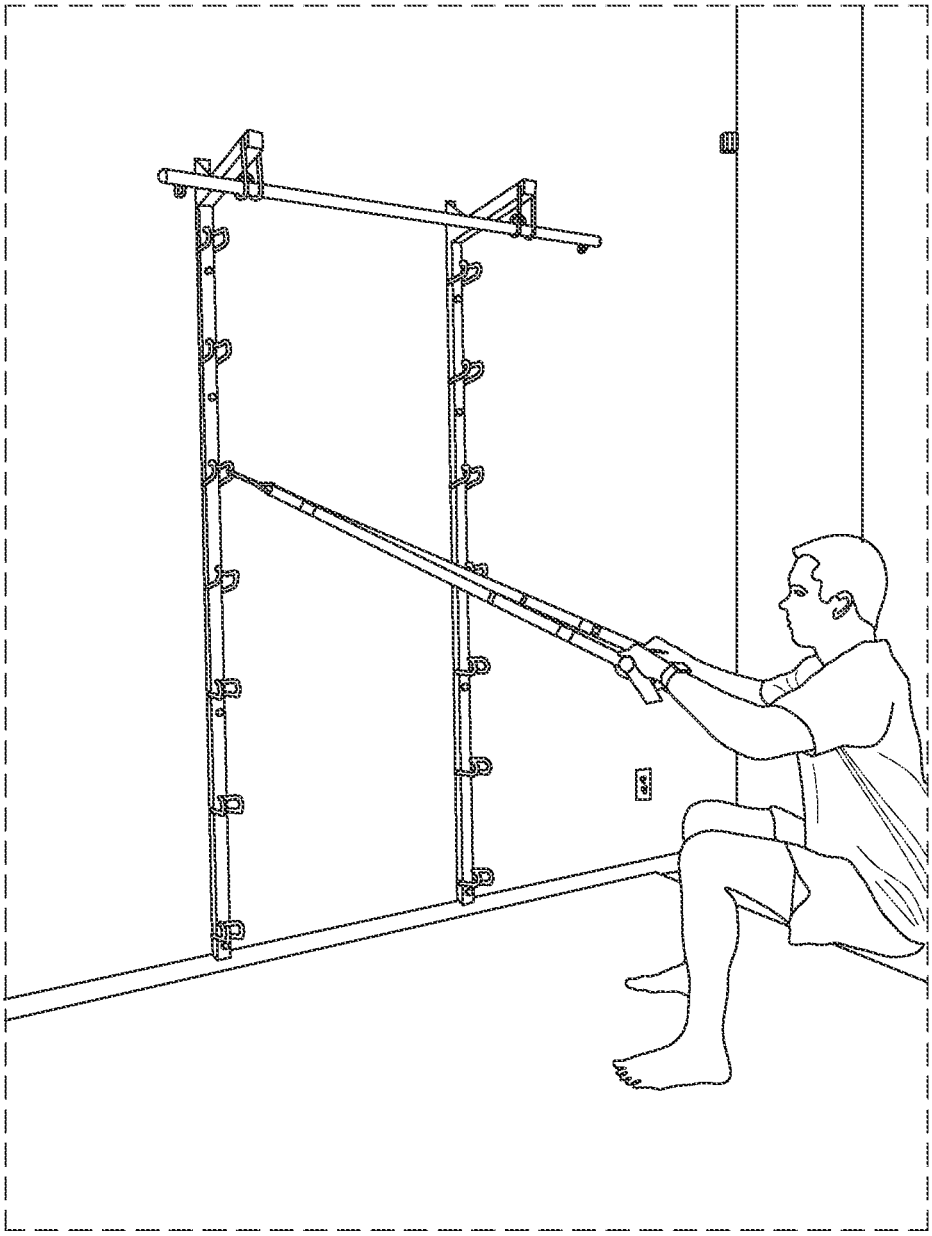
FIG. 28 illustrates a user performing a suspension line squat on the exercise station.

FIG. 28 illustrates a suspension line squat exercise whereby a TRX 700 is connected to a vertical loop hook 120.

Figure 29:
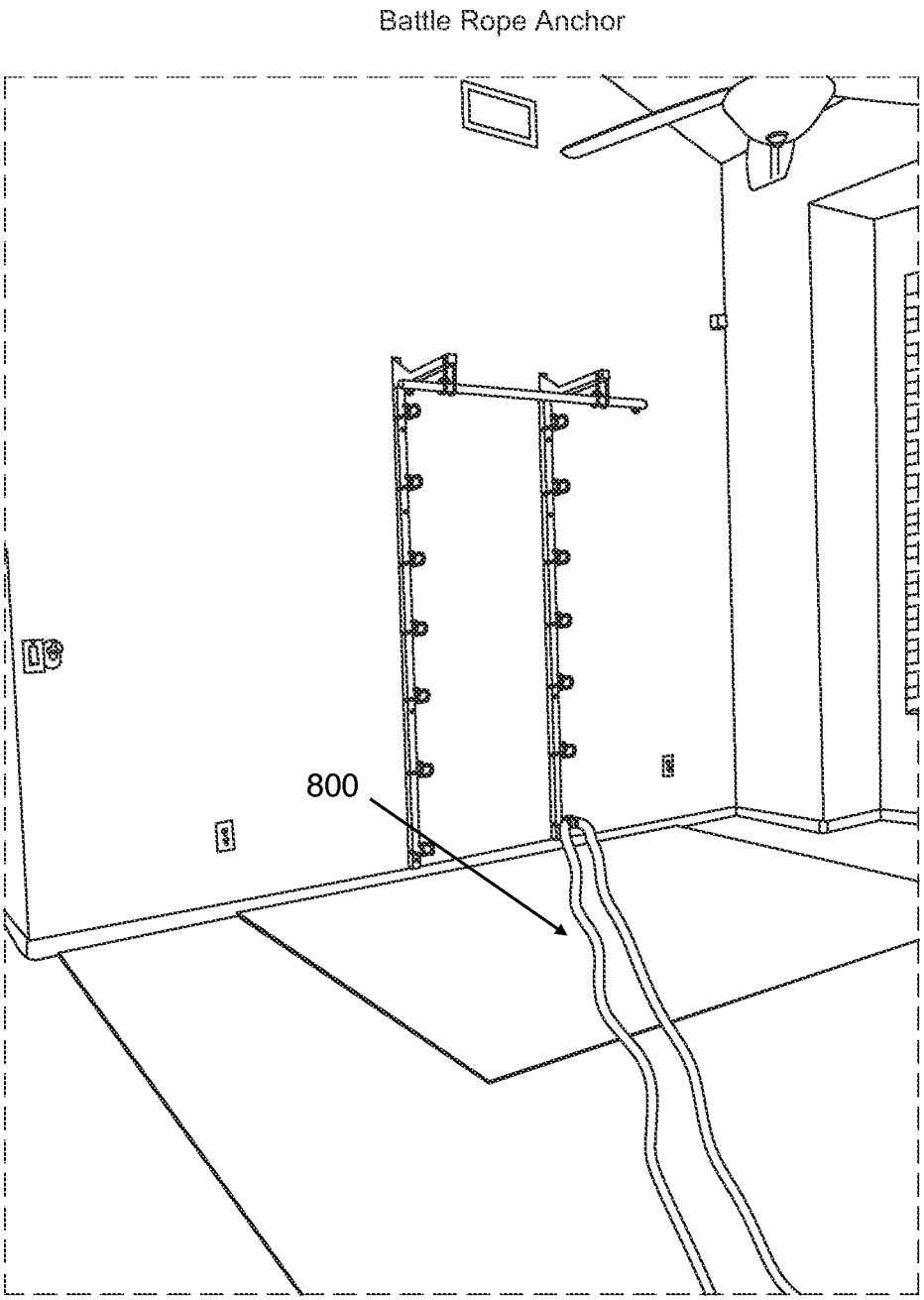
FIG. 29 illustrates a user performing a battle rope anchor.

FIG. 29 illustrates a battle rope exercise whereby a battle rope 800 is connected to a vertical loop hook 120.

Figure 30:
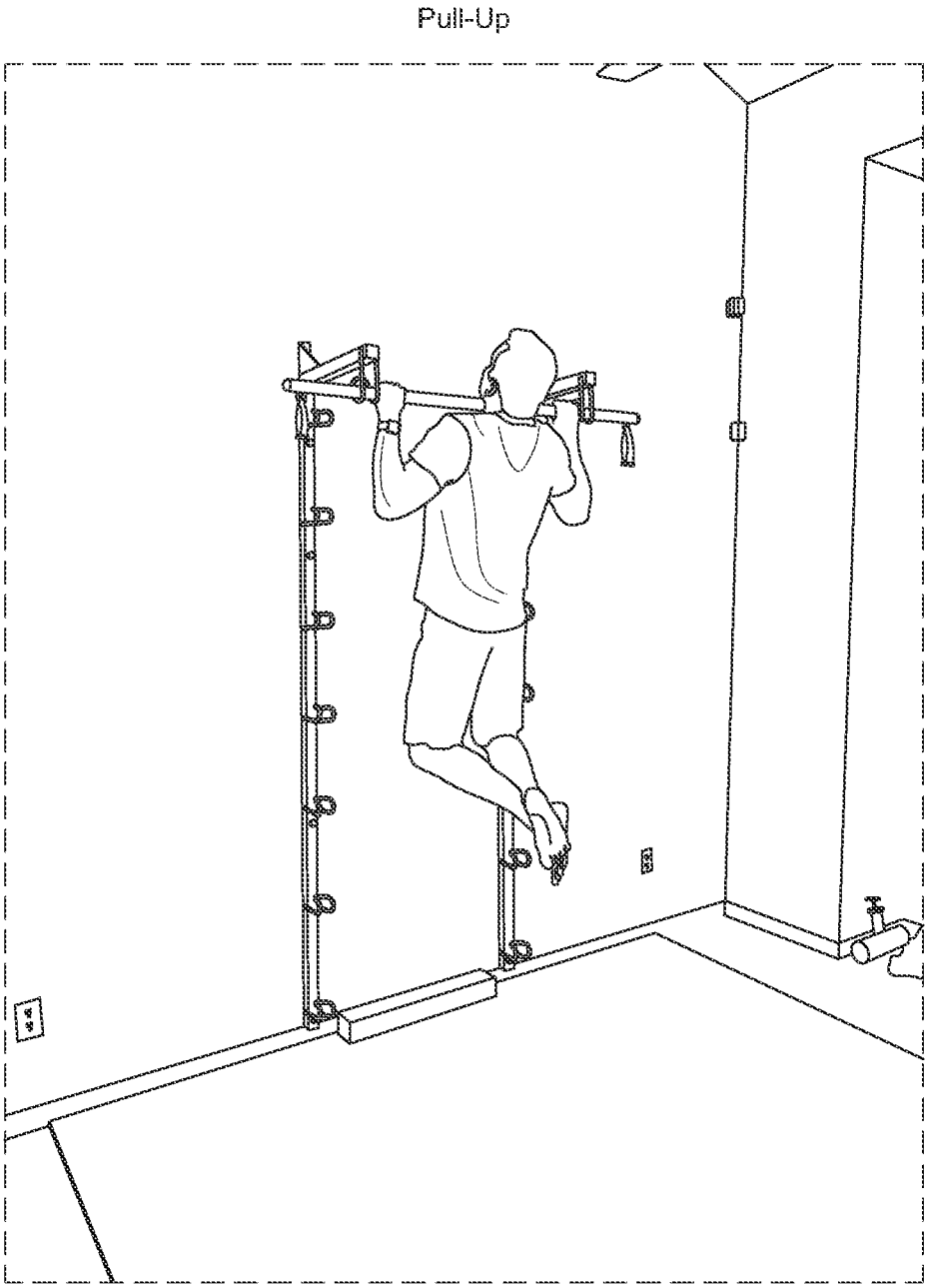
FIG. 30 illustrates a user performing a pull up on the exercise station.

FIG. 30 illustrates a pull up whereby exercise bar 140 positioned in horizontal loop hooks 130.

Figure 31:
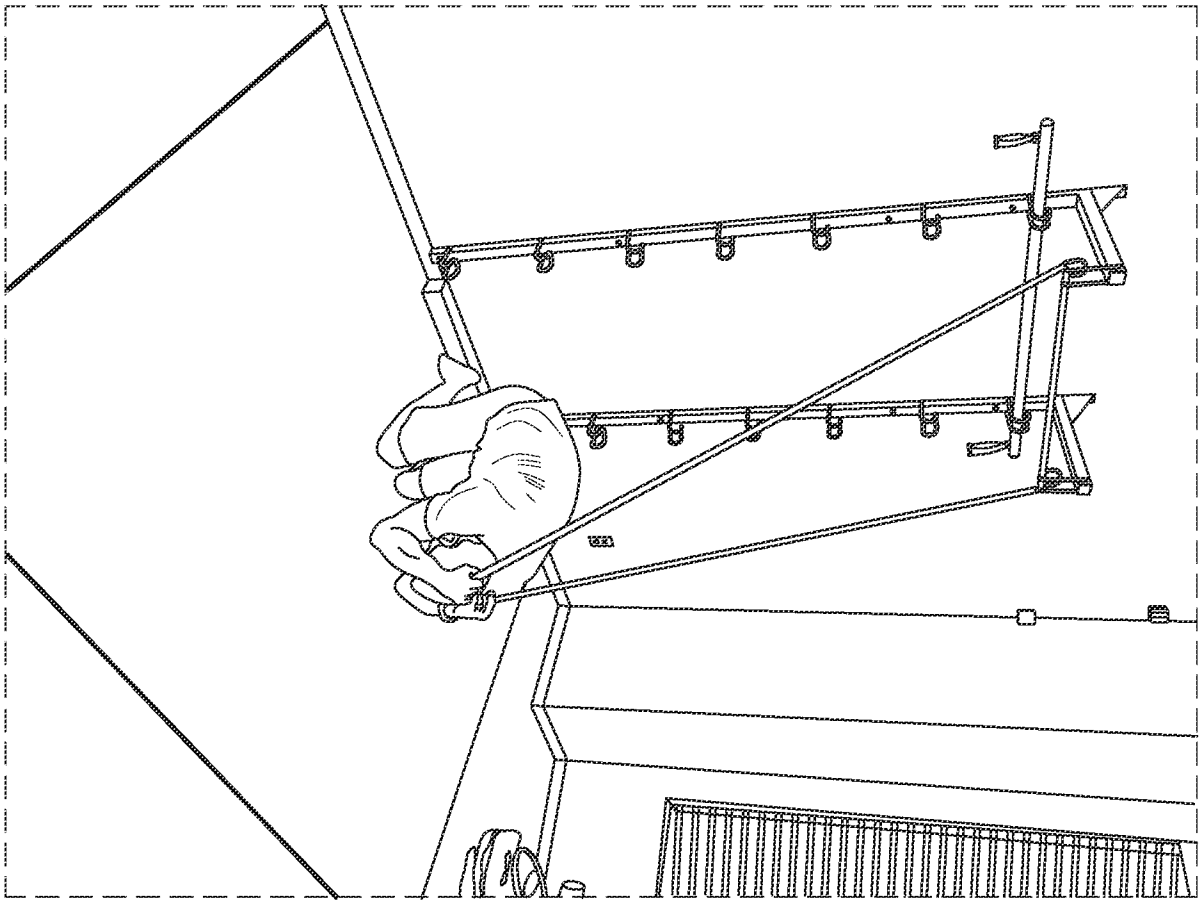
FIG. 31 illustrates a user performing an abdominal crunch exercise on the exercise station.

FIG. 31 illustrates an abdominal crunch exercise whereby a resistance band 200 is hooked on a first horizontal loop hook 130 and hooked on a second horizontal loop hook 130 on opposite horizontal members 114.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. An exercise system comprising:

a first vertical member;

a second vertical member separated by a distance to the first vertical member;

a first horizontal member connected to the first vertical member;

a second horizontal member connected to the second vertical member;

a first set of loop hooks connected to either the first vertical member or the second vertical member; and a second set of loop hooks connected to the first horizontal member or the second horizontal member, wherein the first set of loop hooks and the second set of loop hooks each have a shank, a gape, a bend, a throat and throat opening.

2. The exercise system of claim 1, wherein the first set of loop hooks extend outward from the first vertical member and the second vertical member, wherein the second set of loop hooks extend downward from the first horizontal member and the second horizontal member in a direction perpendicular to the first set of loop hooks.

3. The exercise system of claim 2, wherein the shank is 2.75 inches in length, the gape is 1.25 inches or greater in length, the throat is 1.5 inches in length, wherein there is a distance of 1.5 inches between points on the bend where the distance is parallel to the gape.

4. The exercise system of claim 3, wherein the first set of loop hooks and the second set of loop hooks have a thickness of 0.375 inches.

5. The exercise system of claim 1, wherein the first horizontal member and the second horizontal member are each connected to a gusset that is mountable to a wall, wherein the gussets extend above the first horizontal member and the second horizontal member wherein when mounted a rear of the of the first vertical member and the second vertical member rests against the wall.

6. The exercise system of claim 1, further comprising an exercise bar that is positionable into the first set of loop hooks or the second set of loop hooks wherein the exercise bar is configured to be received by a first loop hook of the first set of loop hooks on the first vertical member and a second loop hook of the first set of loop hooks on the second vertical member.

7. The exercise system of claim 6, wherein the exercise bar has a first anchor point and a second anchor point wherein the first anchor point and the second anchor point are positioned outside the first loop hook on the second set of loop hooks and the second loop hook on the second set of loop hooks.

8. The exercise system of claim 1, further comprising one or more resistance bands wherein the first set of loop hooks and the second set of loop hooks are configured to hook the one or more resistance bands or have the one or more resistance bands threaded through.

9. The exercise system of claim 8, further comprising one or more accessory handles connected to the one or more resistance bands.

10. An exercise system comprising:

two vertical members;

two horizontal members, each of the two horizontal members connected to a corresponding vertical member of the two vertical members;

a plurality of loop hooks connected to the two vertical members or the two horizontal members;

one or more resistance bands connectable to the plurality of loop hooks; and an exercise bar that is connectable to the one or more resistance bands connected to the plurality of loop hooks connected to the two vertical members, wherein the exercise system is in a first configuration used to perform a bar curl or bar squat wherein a first resistance band of the one or more resistance bands has a first end hooked on a first loop hook of the plurality of loop hooks, the first resistance band passing over a second loop hook of the plurality of loop hooks and hooked and rerouted on a third loop hook of the plurality of loop hooks, wherein the first loop hook, the second loop hook, and the third loop hook are positioned on a first vertical member of the two vertical members, wherein a second resistance band of the one or more resistance bands has a first end hooked on a fourth loop hook of the plurality of loop hooks, the second resistance band passing over a fifth loop hook of the plurality of loop hooks and hooked and rerouted on a sixth loop hook of the plurality of loop hooks, wherein the fourth loop hook, the fifth loop hook, and the sixth loop hook are positioned on a second vertical member of the two vertical members, wherein the exercise bar is connected to the first resistance band at a second end and the second resistance band at a second end.

11. An exercise system comprising:

a first vertical member;

a second vertical member separated by a distance to the first vertical member;

a first horizontal member connected to the first vertical member;

a second horizontal member connected to the second vertical member;

a first set of loop hooks connected to either the first vertical member or the second vertical member; and a second set of loop hooks connected to the first horizontal member or the second horizontal member, wherein the first set of loop hooks and the second set of loop hooks each have a shank, a gape, and a distance between points on a bend, wherein the first horizontal member has a first slip member at a first end, wherein the first slip member is positioned into the first vertical member, wherein the second horizontal member has a second slip member at a first end, wherein the second slip member is positioned into the second vertical member.

* * * * *